US009958114B2

(12) United States Patent
Park

(10) Patent No.: US 9,958,114 B2
(45) Date of Patent: May 1, 2018

(54) LINEAR LIGHTING DEVICE

(71) Applicant: LINNO., LTD., Gyeonggi-do (KR)

(72) Inventor: Hyun Yong Park, Seoul (KR)

(73) Assignee: LINNO, LTD., Gyeonggi-do (KR)

( * ) Notice: Subject to any disclaimer, the term of this patent is extended or adjusted under 35 U.S.C. 154(b) by 370 days.

(21) Appl. No.: 14/432,142

(22) PCT Filed: Mar. 4, 2014

(86) PCT No.: PCT/KR2014/001777
§ 371 (c)(1),
(2) Date: Mar. 27, 2015

(87) PCT Pub. No.: WO2014/137142
PCT Pub. Date: Sep. 12, 2014

(65) Prior Publication Data

US 2015/0226384 A1 Aug. 13, 2015

(30) Foreign Application Priority Data

Mar. 5, 2013 (KR) ..... 10-2013-0023205

(51) Int. Cl.
*F21S 4/00* (2016.01)
*F21K 99/00* (2016.01)
(Continued)

(52) U.S. Cl.
CPC ..... *F21K 9/175* (2013.01); *F21S 2/00* (2013.01); *F21V 21/34* (2013.01); *F21S 8/02* (2013.01);
(Continued)

(58) Field of Classification Search
CPC ..... F21K 9/175; F21S 2/00; F21S 8/02; F21S 8/06; F21V 21/34; F21V 21/005; F21V 23/06; F21Y 2103/10; F21Y 2115/10
(Continued)

(56) References Cited

U.S. PATENT DOCUMENTS 4,475,226 A 10/1984 Greenberg
5,810,468 A 9/1998 Shimada
(Continued)

FOREIGN PATENT DOCUMENTS

DE 202010005681 U1 9/2010
EP 2113716 A1 11/2009
(Continued)

OTHER PUBLICATIONS

Machine English Translation of JP2008218186A Sep. 18, 2008.*
(Continued)

*Primary Examiner* — Elmito Breval
*Assistant Examiner* — Glenn Zimmerman
(74) *Attorney, Agent, or Firm* — Wolf, Greenfield & Sacks, P.C.

(57) ABSTRACT

A linear lighting device may include: an installation rail including a housing and a power supply terminal, the housing being fixed to an installation object surface and having an accommodating space formed therein, the accommodating space having an open side in one surface thereof, the power supply terminal being disposed in the accommodating space of the housing in a length direction thereof; at least one linear lighting module including a power connection terminal and a light emitting device, the power connection terminal being electrically connected to the power supply terminal, the light emitting device being electrically connected to the power connection terminal, the linear lighting module being detachably coupled to the accommodating space of the housing; and a light transmissive cover detachably coupled to the housing so as to close the open side of the accommodating space of the housing.

15 Claims, 18 Drawing Sheets

(51) Int. Cl.

| | |
|---|---|
| ***F21S 2/00*** | (2016.01) |
| ***F21V 21/34*** | (2006.01) |
| *F21S 8/02* | (2006.01) |
| *F21S 8/06* | (2006.01) |
| *F21V 23/06* | (2006.01) |
| *F21V 21/005* | (2006.01) |
| *F21Y 103/10* | (2016.01) |
| *F21Y 115/10* | (2016.01) |

(52) U.S. Cl.
CPC ..... *F21S 8/06* (2013.01); *F21V 21/005* (2013.01); *F21V 23/06* (2013.01); *F21Y 2103/10* (2016.08); *F21Y 2115/10* (2016.08)

(58) Field of Classification Search
USPC ..... 362/223, 225, 219
See application file for complete search history.

(56) References Cited

U.S. PATENT DOCUMENTS

| | | | | |
|---|---|---|---|---|
| 6,231,205 | B1 | 5/2001 | Slesinger et al. | |
| 2003/0081413 | A1* | 5/2003 | Weedon | F21S 2/00 362/219 |
| 2006/0262521 | A1 | 11/2006 | Piepgras et al. | |
| 2010/0271812 | A1 | 10/2010 | Harnischmacher et al. | |
| 2012/0124926 | A1* | 5/2012 | Kuo | E04C 1/42 52/306 |
| 2012/0212951 | A1* | 8/2012 | Lai | F21V 23/002 362/218 |
| 2013/0201673 | A1* | 8/2013 | Chien | F21V 21/088 362/217.13 |
| 2013/0258682 | A1* | 10/2013 | Pino | H01R 13/5219 362/382 |

FOREIGN PATENT DOCUMENTS

| | | | | |
|---|---|---|---|---|
| JP | 2005-222803 | A | | 8/2005 |
| JP | 2008218186 | A | * | 9/2008 |
| JP | 2008300242 | A | | 12/2008 |
| JP | 3150503 | U | | 5/2009 |
| JP | 2011070810 | A | | 4/2011 |
| JP | 2012099414 | A | | 5/2012 |
| KR | 10-1064581 | B1 | | 3/2010 |
| KR | 10-0948313 | B1 | | 9/2011 |
| KR | 1020110122942 | A | | 11/2011 |
| WO | WO 95/21352 | A1 | | 8/1995 |
| WO | WO 01/91248 | A1 | | 11/2001 |

OTHER PUBLICATIONS

Machine English Translation of JP2005222803A Aug. 18, 2005.*
International Search Report dated Jun. 27, 2014 from corresponding International Application No. PCT/KR2014/001777.
Extended European Search Report for Application No. EP 14759794.2 dated Nov. 3, 2016.

* cited by examiner

LINEAR LIGHTING DEVICE

RELATED APPLICATIONS

This application is the national phase of International Application No. PCT/KR2014/001777 filed on Mar. 4, 2014, which claims priority to Korean Patent Application No. 10-2013-0023205, filed on Mar. 5, 2013, which applications are incorporated herein by reference to the maximum extent allowable by law.

TECHNICAL FIELD

The present invention relates to a linear lighting device and more particularly, to a linear lighting device capable of being simply constructed by simply connecting a plurality of housings to each other in configuring an installation rail for installing a lighting module, as well as by simultaneously, electrically connecting the housings to each other in a structural connection operation.

BACKGROUND ART

Since fluorescent lamps used as general lighting lamps have disadvantages such as low levels of illumination and energy efficiency, lighting modules using light emitting diodes (hereinafter, referred to as "LED") have been recently, frequently used as lighting lamps having a relatively high level of illumination while requiring a relatively low level of power consumption as compared to the fluorescent lamps.

However, the majority of such LED lighting modules may be configured to replace existing fluorescent lamps to be used in a lamp device for existing fluorescent lamps, while maintaining the exteriors of the existing fluorescent lamps. Thus, it is inevitable that the LED lighting modules still have the inconvenience of an existing coupling structure of a fluorescent lamp and sockets, in which a lighting module is coupled to or separated from the lamp device by a method of rotating the lighting module in a state of inserting terminals provided on both ends of the lighting module into the sockets of the lamp device, during attachment and detachment processes.

In addition, in the case of configuring linear illumination using the LED lighting module, a difference in levels of illuminance between a disposition region of the lighting module and a disposition region of the socket may occur, whereby continuous linear illumination may not be provided.

In addition, a bar type LED lighting module has been suggested in order to configure linear illumination, but the LED lighting module has a socket disposed on a side surface thereof, the socket being provided for supplying power. Thus, in order to separate a single LED lighting module in a state in which a plurality of LED lighting modules are disposed in a row, it is problematic in that all of lighting modules ranging from an outermost LED lighting module to a corresponding LED lighting module need to be separated and the separated LED lighting modules need to be coupled again after replacing the corresponding LED lighting module.

In addition, in the case of a linear lighting device according to the related art, in a state in which a pair of rails for installation of a lighting module are disposed to have a predetermined angle therebetween at a corner portion of a construction object surface, respective end portions of the installation rails are slantly cut and are disposed to face each other and subsequently, a wiring operation for electrically connecting power supply terminals of the both installation rails to each other is separately conducted.

However, in the operation, since it is required to slantly cut the respective end portions of the rails on the spot and to install a wiring for connecting the power supply terminals of the respective installation rails to each other, an installation process may be complicated and the execution of works may be difficult.

Meanwhile, in order to solve such difficulties, a construction method in which a corner member for connecting the installation rails is previously manufactured and thus, a process of slantly cutting end portions of the installation rails is omitted has been suggested. However, since the corner member is previously manufactured to be bent at an angle of 60 degrees, 90 degrees, 120 degrees or the like, there is a limitation in that a lighting device needs to be disposed depending on an angle of the corner member.

In particular, in installing a linear lighting device along an edge of a ceiling in the space, in the case that a corner angle of an installation object surface is different from an angle of a corner member, an error between the angles may occur in one corner portion and may be expanded in a direction away from the corner portion, such that an illumination line may be gradually spaced apart from the edge of the space, thereby leading to a deterioration in construction quality.

Moreover, even in the case of using the corner member, a limitation in which a wiring operation for electrically connecting power supply terminals of the respective installation rails to each other needs to be separately conducted, still remains.

DETAILED DESCRIPTION OF THE INVENTION

Technical Problem

Therefore, to solve the above problem, the present invention may provide a linear lighting device in which an installation rail and a lighting module may be simply coupled to and separated from each other and at the same time, a structural connection and an electrical connection thereof may be stably formed.

An aspect of the present invention may also provide a linear lighting device allowing for a significant reduction in the discomforts of electrical wirings or constructions and the risk of an electric shock by connecting a housing and an external ground line to each other, as well as by connecting a power supply terminal and an external power line to each other through simply coupling an end cap portion to an end portion of the housing.

An aspect of the present invention may also provide a linear lighting device capable of preventing an operator from getting shocked during an operation by keeping a power supply terminal disposed within a housing from being exposed to an opening.

An aspect of the present invention may also provide a linear lighting device capable of significantly reducing the risk of an electrical accident, by preventing a pair of power connection terminals provided on a lighting module from being electrically connected to each other and at the same time, by elastically supporting the power connection terminal toward a power supply terminal.

An aspect of the present invention may also provide a linear lighting device allowing for simple maintenance thereof by facilitating the separation or insertion of a single lighting module in a state in which a plurality of lighting modules are arranged in a row to configure linear illumination, because the lighting module may be vertically inserted into and separated from an accommodating space of a housing.

An aspect of the present invention may also provide a linear lighting device capable of being easily constructed by simply connecting a plurality of housing to each other in configuring an installation rail for installation of a lighting module, as well as by simultaneously, electrically connecting the housings to each other in a structural connection operation.

An aspect of the present invention may also provide a linear lighting device capable of freely, electrically connecting housings to each other depending on an angle between the housings, even in the case that the housings are arranged to have a predetermined angle therebetween as in the case of a corner portion.

An aspect of the present invention may also provide a linear lighting device capable of improving product quality by not exposing conductive cables connecting second connection terminals of a plurality of insertion bodies to each other.

Solution to Problem

An aspect of the present invention is accomplished by a linear lighting device including: an installation rail including a housing and a power supply terminal, the housing being fixed to an installation object surface and having an accommodating space formed therein, the accommodating space having an open side in one surface thereof, the power supply terminal being disposed in the accommodating space of the housing in a length direction thereof; at least one linear lighting module including a power connection terminal and a light emitting device, the power connection terminal being electrically connected to the power supply terminal, the light emitting device being electrically connected to the power connection terminal, the linear lighting module being detachably coupled to the accommodating space of the housing; and a light transmissive cover detachably coupled to the housing so as to close the open side of the accommodating space of the housing.

The installation rail may further include an end cap portion coupled to an end portion of the housing, and the end cap portion may include a ground plug connecting the housing formed of a conductive material and an external ground line to each other.

The end cap portion may further include a power plug connecting the power connection terminal of the housing and an external power line to each other.

The power supply terminal may be disposed on an open side in the accommodating space of the housing in a length direction thereof, and the power connection terminal may be disposed on an upper surface of the lighting module such that a side portion of the power connection terminal contacts a side portion of the power supply terminal in a state in which the lighting module is coupled to the housing.

The power supply terminal may be electrically insulated from the housing by an insulating member accommodated in the accommodating space of the housing.

The installation rail may have a first coupling portion formed thereon and the lighting module may have a second coupling portion formed in a position corresponding to the first coupling portion, the first coupling portion and the second coupling portion may be engaged with each other in a state in which the lighting module is accommodated in the accommodating space of the housing.

The first coupling portion and the second coupling portion may have protrusions formed on surfaces thereof facing each other, the protrusions may be engaged with each other, and both ends of the protrusion of the second coupling portion may be provided with inclined surfaces to guide separation of the second coupling portion.

The power supply terminal may be accommodated in a rail groove of an insulating member accommodated in the accommodating space of the housing and may be electrically insulated from the housing, and the rail groove may be provided with an open groove allowing the power supply terminal to be exposed and the open groove may be provided on a side portion of the rail groove facing the power connection terminal.

The power supply terminal may be formed of a pair of power supply terminals which are disposed in parallel and which are spaced apart from each other, while the power connection terminal is formed of a pair of power connection terminals which are disposed in parallel and which are spaced apart from each other, and one pair of the pair of power supply terminals and the pair of power connection terminals may be inserted into a space between the other pair of the pair of power supply terminals and the pair of power connection terminals.

The power connection terminals may be inserted into the space between the power supply terminals, and an elastic member formed of an elastic material may be inserted into a space between the pair of power connection terminals and elastically supports the power connection terminals toward the power supply terminals.

The lighting module may be provided with an insertion projection which covers the pair of power connection terminals and which is accommodated in the space between the power supply terminals, wherein open holes are formed in surfaces of the insertion projection facing the power supply terminals, and the power connection terminals may be provided with contact protrusions which are protruded outwardly from the insertion projection through the open holes to come into contact with the power supply terminals.

The installation rail may further include a side member detachably coupled to a side portion of the housing.

The side member may have a catching portion which is bent from a bottom portion thereof and which is adhered to an outer circumferential portion of the installation object surface around an installation groove.

The installation rail may further include a fixing member which is fixed to an upper surface of the housing and which has elastic portions inclinedly disposed at both sides thereof, the fixing member being adhered to an inner circumferential portion of the installation object surface around the installation groove.

A position of the fixing member may be adjusted by an adjusting member in a thickness direction of the installation object surface.

First coupling portions and second coupling portions detachably engaged with each other may be disposed on surfaces where the side member and the housing are coupled, the first coupling portions and the second coupling portions being disposed in parallel in a length direction of the housing.

The installation rail may further include a connection member including an insertion body and a power connection terminal, the insertion body being vertically and detachably inserted into each of accommodating spaces of a pair of housings adjacent to each other, the power connection terminal being fixed to the insertion body and being connected to each of power supply terminals of the both housings.

The connection member may include a plurality of insertion bodies and a plurality of power connection terminals, the plurality of insertion bodies and the plurality of power connection terminals being respectively inserted into the accommodating spaces of the pair of housings adjacent to each other, the plurality of power connection terminals being connected to each other by a conductive cable.

The connection member may further include a flexible tube, both an edge of end portions of the flexible tube being respectively fixed to an edge of end portions of the insertion bodies.

A first coupling portion and a second coupling portion may be formed on surfaces where the insertion body and the housing face each other, the first coupling portion and the second coupling portion being engaged with each other in a state in which the insertion body is inserted into the accommodating space of the housing.

In a state in which the lighting module is inserted in the accommodating space of the housing, a space may be formed between the lighting module and the housing, the insertion body being accommodated in the space.

Advantageous Effects of the Invention

According to exemplary embodiments of the present invention, a linear lighting device in which an installation rail and a lighting module may be simply coupled to and separated from each other and at the same time, a structural connection and an electrical connection thereof may be stably formed may be provided.

Also, a linear lighting device allowing for a significant reduction in the discomforts of electrical wirings or constructions and the risk of an electric shock by connecting a housing and an external ground line to each other, as well as by connecting a power supply terminal and an external power line to each other through simply coupling an end cap portion to an end portion of the housing may be provided.

Also, a linear lighting device capable of preventing an operator from getting shocked during an operation by keeping a power supply terminal disposed within a housing from being exposed to an opening may be provided.

Also, a linear lighting device capable of significantly reducing the risk of a short circuit or the occurrence of sparks, by preventing a pair of power connection terminals provided on a lighting module from being electrically connected to each other and at the same time, by elastically supporting the power connection terminal toward a power supply terminal may be provided.

Also, a linear lighting device allowing for simple maintenance thereof by facilitating the separation or insertion of a single lighting module in a state in which a plurality of lighting modules are arranged in a row to configure linear illumination, because the lighting module may be vertically inserted into and separated from an accommodating space of a housing may be provided.

Also, a linear lighting device capable of being easily constructed by simply connecting a plurality of housing to each other in configuring an installation rail for installation of a lighting module, as well as by simultaneously, electrically connecting the housings to each other in a structural connection operation may be provided.

Moreover, a linear lighting device capable of freely, electrically connecting housings to each other depending on an angle between the housings, even in the case that the housings are arranged to have a predetermined angle therebetween as in the case of a corner portion may be provided.

Further, a linear lighting device capable of improving product quality by not exposing conductive cables connecting second connection terminals of a plurality of insertion bodies to each other may be provided.

MODE FOR INVENTION

Figure 1:
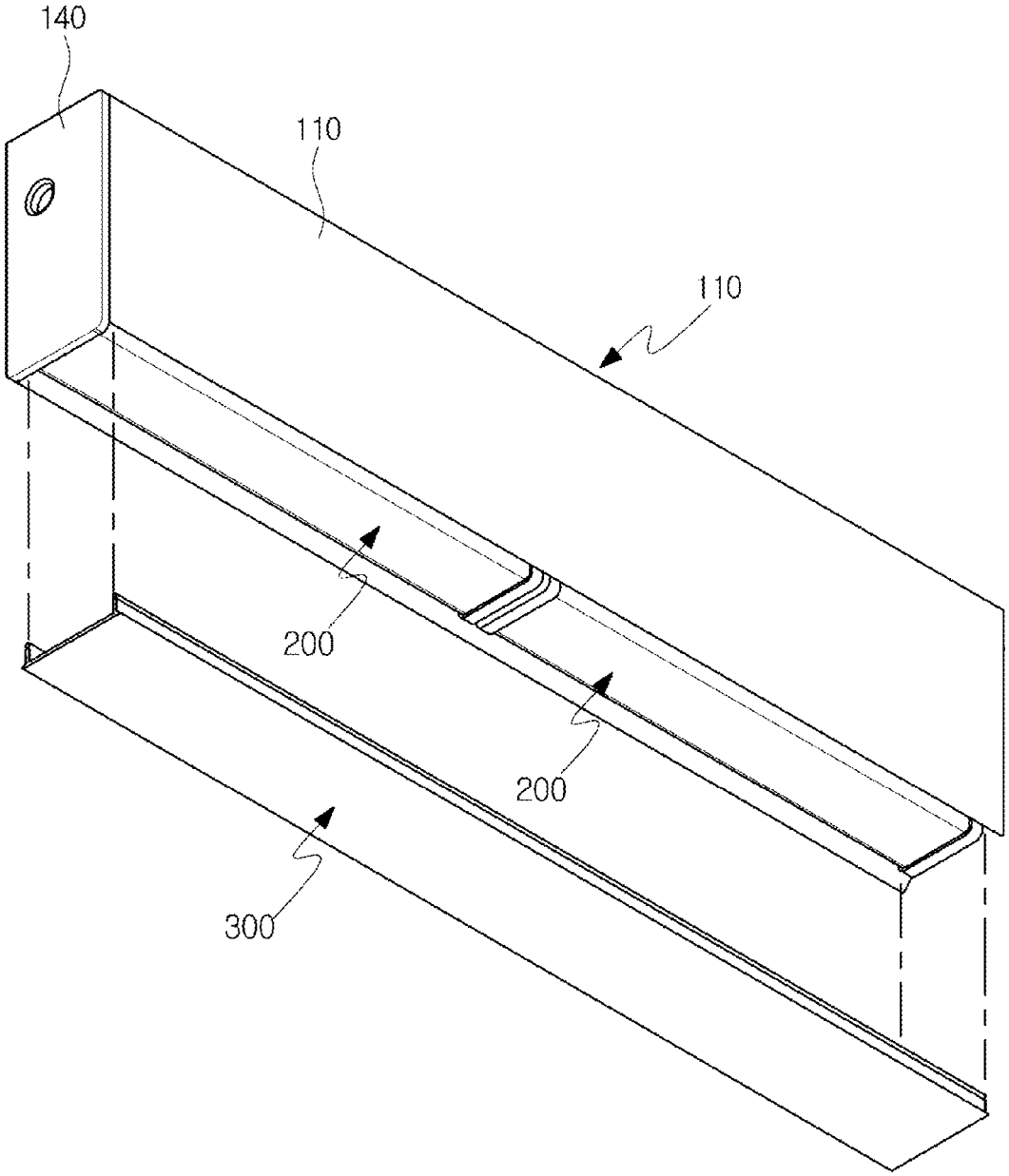
FIG. 1 is a perspective view of a linear lighting device according to a first exemplary embodiment of the present invention.

Prior to the description, in several embodiments, components having the same configurations will be described using the same reference numerals representatively in a first exemplary embodiment, and other components different from those of the first exemplary embodiment will be described in other exemplary embodiments.

Hereinafter, a linear lighting device according to the first exemplary embodiment of the present invention will be described in detail with reference to the attached drawings.

Figure 2:
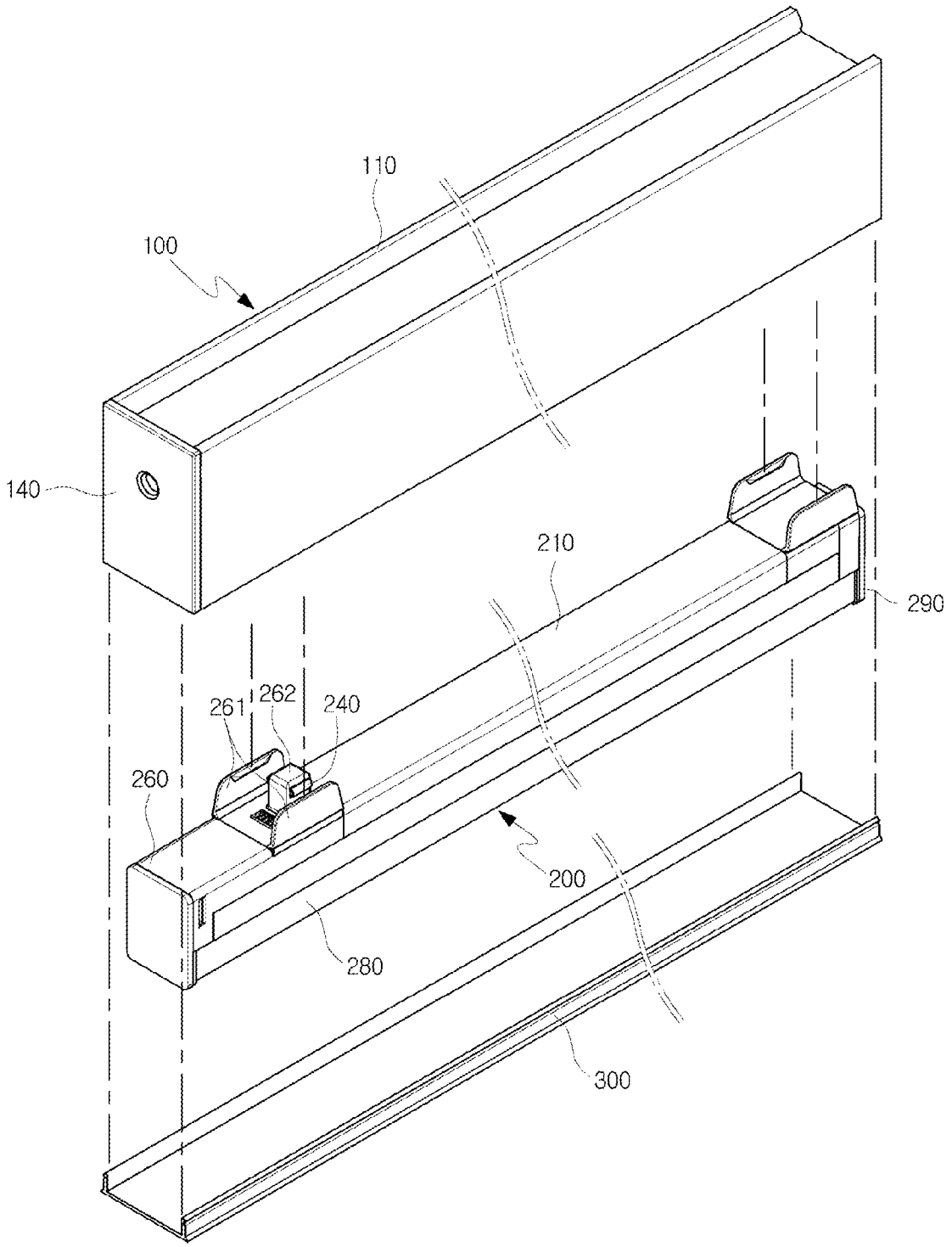
FIG. 2 is an exploded perspective view of the linear lighting device according to the first exemplary embodiment of the present invention.
Figure 3:
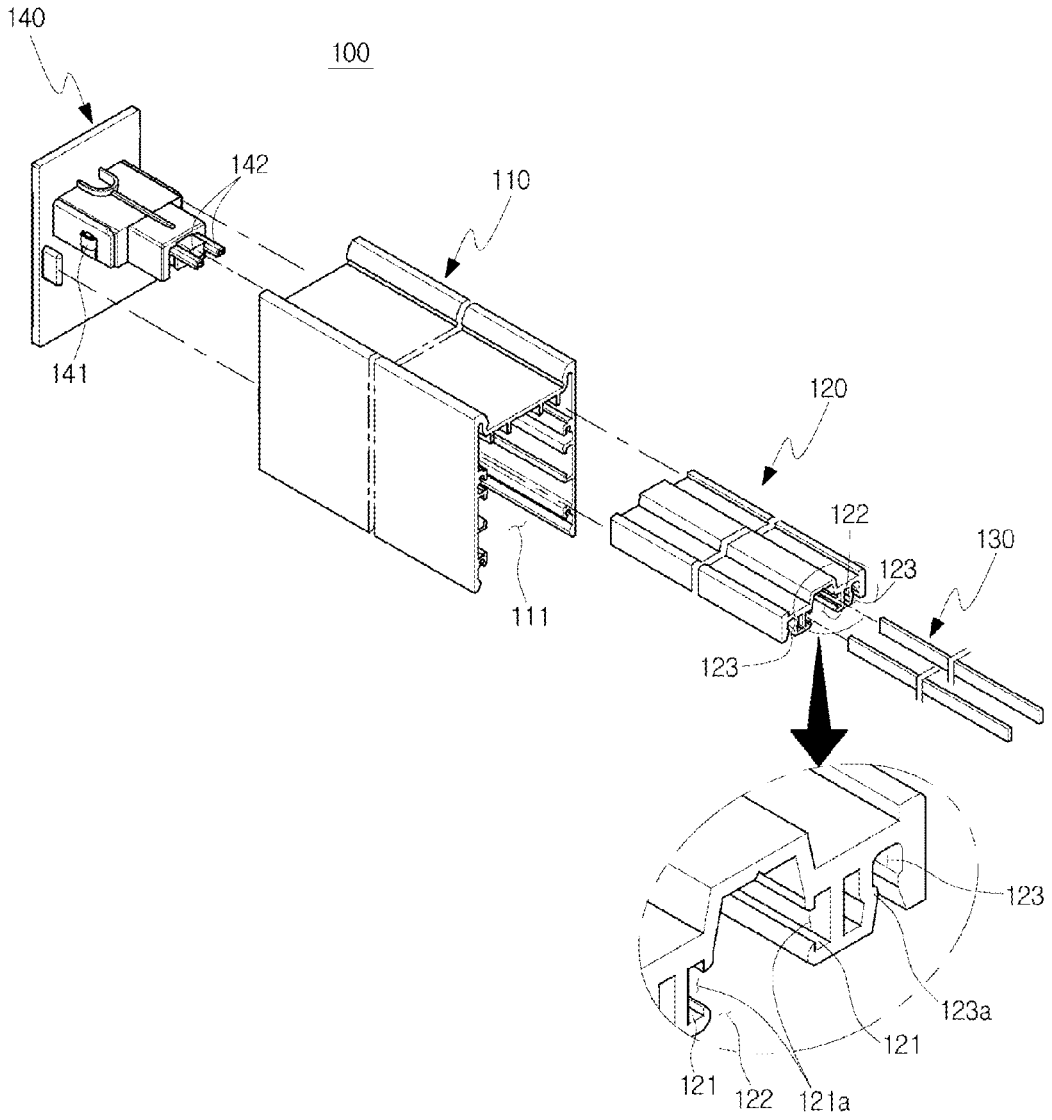
FIG. 3 is an exploded perspective view of an installation rail of the linear lighting device according to the first exemplary embodiment of the present invention.
Figure 4:
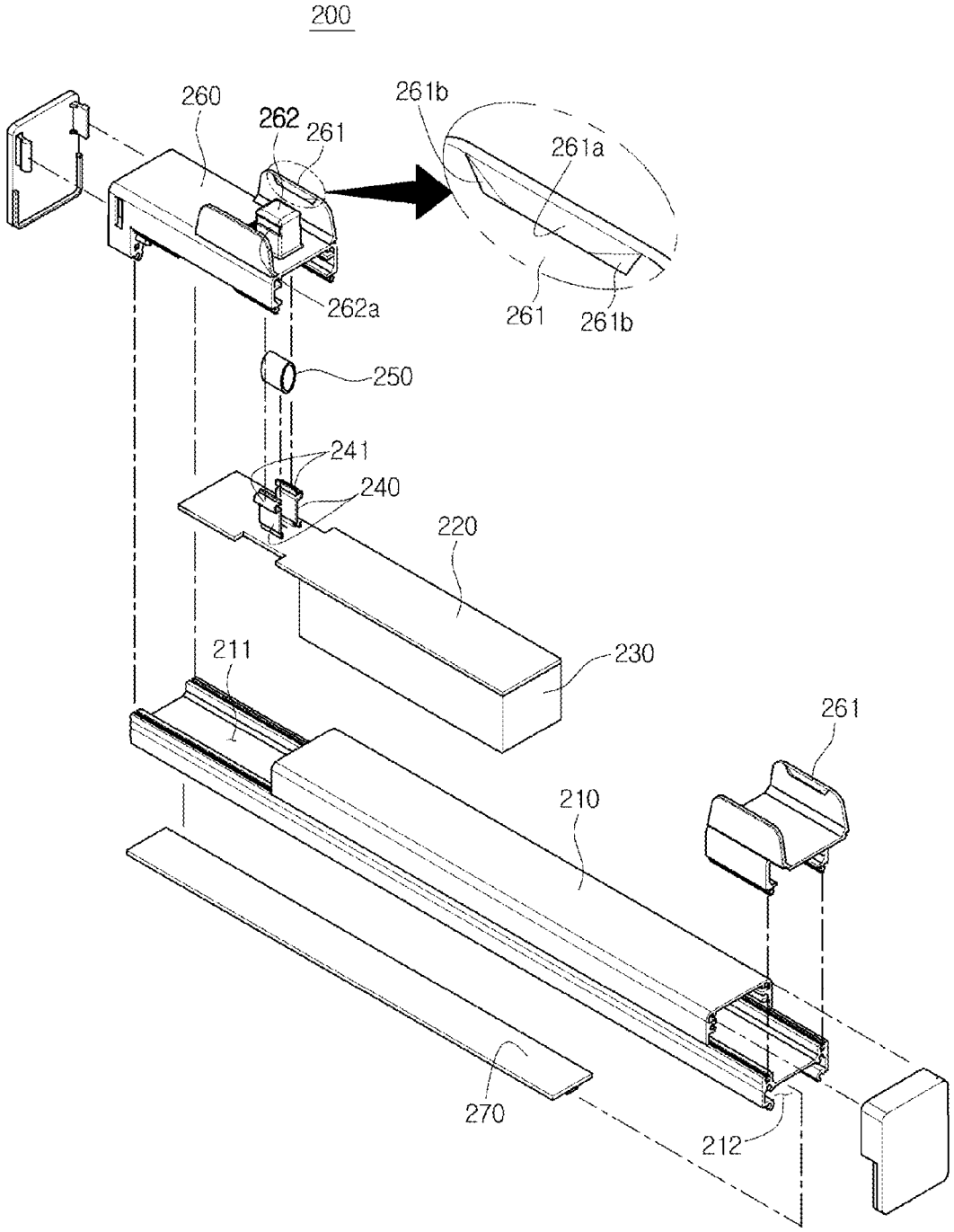
FIG. 4 is an exploded perspective view of a lighting module of the linear lighting device according to the first exemplary embodiment of the present invention.

FIG. 1 is a perspective view of a linear lighting device according to a first exemplary embodiment of the present invention. FIG. 2 is an exploded perspective view of the linear lighting device according to the first exemplary embodiment of the present invention. FIG. 3 is an exploded perspective view of an installation rail of the linear lighting device according to the first exemplary embodiment of the present invention. FIG. 4 is an exploded perspective view of a lighting module of the linear lighting device according to the first exemplary embodiment of the present invention.

The linear lighting device according to the first exemplary embodiment of the present invention as illustrated in FIGS. 1 through 4 may be mainly configured to include an installation rail 100 installed on an installation object surface, a plurality of lighting modules 200 detachably coupled to the installation rail 100, and a light transmissive cover 300 closing an open region of the installation rail 100.

The installation rail 100 may be configured to include a housing 110, an insulating member 120 fixed into the housing 110, power supply terminals 130 fixed to the insulating member 120 and electrically insulated from the housing 110, and end cap portions 140 closing end portions of the housing 110.

The housing 110 may have a "ㅁ" shaped cross-sectional structure in which a lower portion thereof is opened and thus, may have an accommodating space 111 having an open side in a lower portion thereof. The housing 110 may be formed of a conductive metal material such as aluminum and be installed on the installation object surface such as a ceiling in a length direction thereof.

The insulating member 120 may be formed of an insulating material and may be installed within the accommodating space 111 of the housing 110. A pair of rail grooves 121 may be formed in positions disposed in parallel and spaced apart from each other on surfaces of the insulating member 120 facing the accommodating space 111, in a length direction thereof, and an accommodation groove 122 may be provided between the pair of rail grooves 121. First coupling portions 123 having groove shapes may be formed in edges of both sides of the insulating member 120 in a length direction thereof. The rail grooves 121 may be formed to cover the power supply terminals 130, and open grooves 121*a* may be formed in surfaces of the insulating member 120 facing the accommodation groove 122.

The power supply terminals 130 may be provided as a pair of power supply terminals 130 in order to provide a positive electrode, may be accommodated in the rail grooves 121 of the insulating member 120, and may be exposed to the accommodation groove 122 through the open grooves 121*a* of the insulating member 120.

Each of the end cap portions 140 may be coupled to one end portion of the housing 110 and close the open side of the end portion thereof. A surface of the end cap portion inserted into the end portion of the housing 110 may be provided with ground plugs 141 contacting the housing 110 and power plugs 142 contacting power connection terminals 240, the ground plugs 141 being connected to an external ground line, and the power plugs 142 being connected to an external power line.

The lighting module 200 may be detachably installed on the housing 110 and receive power from the power supply terminals 130 to thereby emit light. The lighting module 200 may be provided in plural and the plurality of lighting modules 200 may be disposed in a row in the accommodating space 111 of the housing 110.

The lighting module 200 may be configured to include: a body 210 including an upper opening 211 and a lower opening 212 vertically disposed and accommodated in the accommodating space 111 of the housing 110; a circuit board 220 fixed to an internal space of the body 210 through the upper opening 211 of the body 210, a switching mode power supply (SMPS) 230 fixed to the circuit board 220; the power connection terminals 240 fixedly installed on an upper portion of the circuit board 220 in a direction perpendicular with respect to the circuit board 220 and electrically connected to the SMPS 230; an upper cover 260 having second coupling portions 261 formed on an upper surface of the upper cover 260 and closing the upper opening 211 of the body 210, the second coupling portions 261 having protrusion shapes and being engaged with the first coupling portions 123 of the insulating member 120; and a plurality of light emitting devices 270 disposed on a bottom surface of the lower opening 212 of the body 210 to be spaced apart from each other in a length direction thereof and electrically connected to the circuit board 220.

The body 210 is configured of an upper body and a lower body and the upper body may be formed of a metal material to allow for the maintenance of structural rigidity thereof while the lower body may be formed of an insulating material such as a plastic material to significantly reduce the risk of an operator's electric shock.

Meanwhile, the upper cover 260 coupled to the upper surface of the body 210 may be provided with an insertion projection 262 protruding from the upper cover 260 and inserted into the accommodating groove 122 between the power supply terminals 130 as the lighting module 200 is accommodated in the accommodating space 111 of the housing 110. Open holes 262*a* may be formed in surfaces of the insertion projection 262 facing the power supply terminals 130.

The power connection terminals 240 may be configured as a pair of power connection terminals so as to be electrically connected to the pair of power supply terminals 130, and may be disposed in positions corresponding to the pair of power supply terminals 130. Bottom portions of the power connection terminals 240 may be fixed to the circuit board 220, and top portions thereof may be disposed in the inside of the insertion projection 262 while not being fixed thereto. In addition, the top portions of the power connection terminals 240 may be provided with contact protrusions 241 outwardly protruded through the open holes 262*a* of the insertion projection 262 to come into contact with the power supply terminals 130.

An elastic member 250 having elasticity such as silicon may be disposed between a single pair of the power connection terminals 240 and may prevent the pair of power connection terminals 240 from being electrically connected to each other while elastically supporting the power connection terminals 240 toward the power supply terminals 130.

Meanwhile, in a state in which the lighting module 200 is coupled to the accommodating space 111 of the housing 110, the upper cover 260 may be disposed to be spaced apart from the insulating member 120 by a predetermined distance, and the second coupling portions 261 of the upper cover 260 may be disposed in positions of the body 210 spaced apart from one end of the body 210 toward a central portion of the body 210 by a predetermined distance. In addition, protrusions 123*a* and 261*a* may be formed on surfaces of the first coupling portions 123 and the second coupling portions 261 facing each other, the protrusions 123*a* and 261*a* being engaged with each other, and both ends of the protrusions 261*a* of the second coupling portions 261 may be provided inclined surfaces 261*b* for guiding separation of the second coupling portions 261.

Meanwhile, in a case in which a length of the lighting module 200 is small, the second coupling portions 261 may be disposed in the central portion of the body 210. In a case in which the length of the lighting module 200 is great, the second coupling portions 261 may be respectively disposed in positions spaced apart from both ends of the body 210 toward the central portion thereof by a predetermined distance.

The light transmissive cover 300 covering the opening of the housing 110 and closing the accommodating space 111, may be formed of a light diffusion material in order to improve a degree of uniformity of illumination light provided from the plurality of lighting modules 200 or may have prism patterns for light diffusion on a surface thereof.

Figure 5:
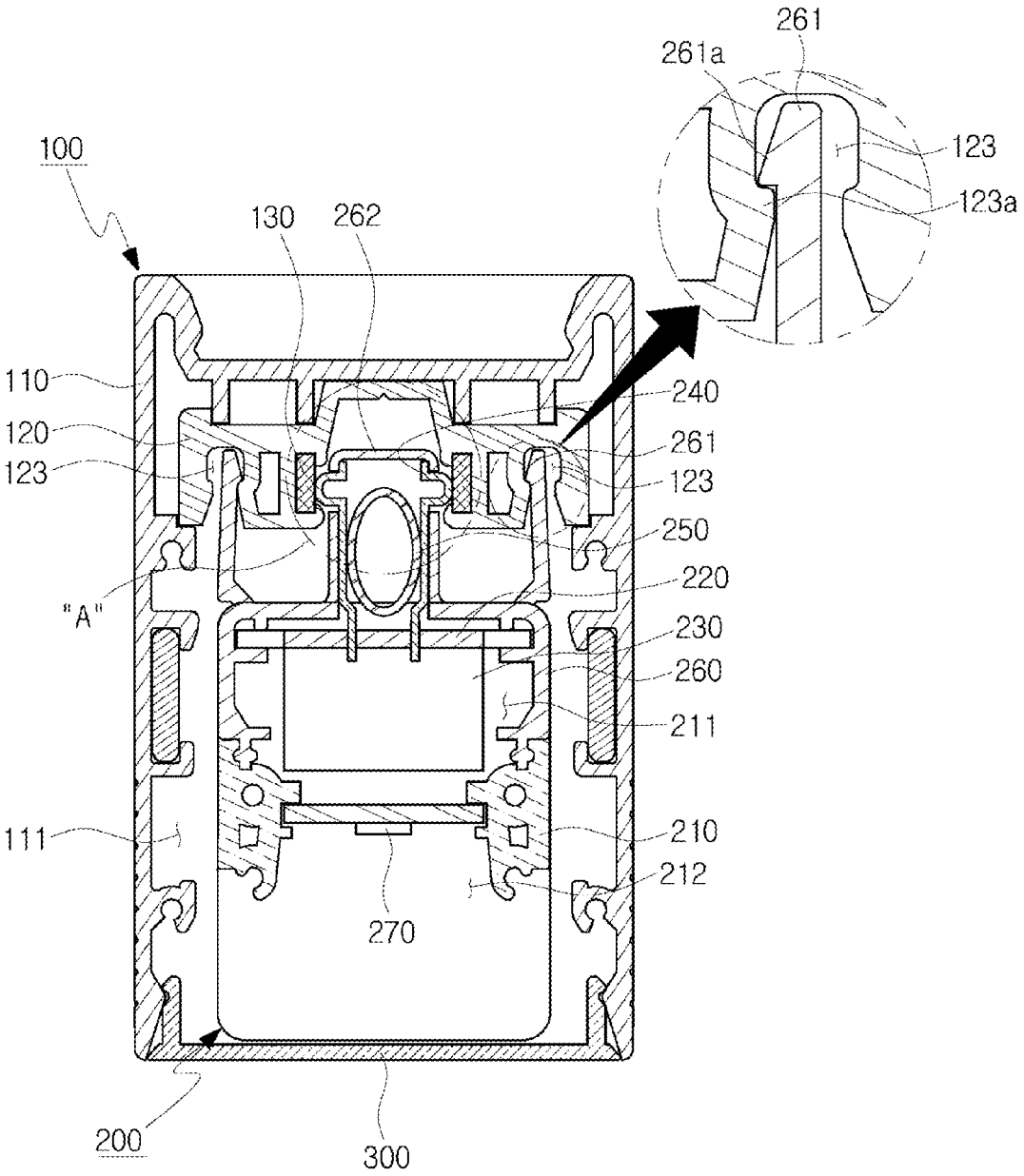
FIG. 5 is a side cross-sectional view of the linear lighting device according to the first exemplary embodiment of the present invention.
Figure 6:
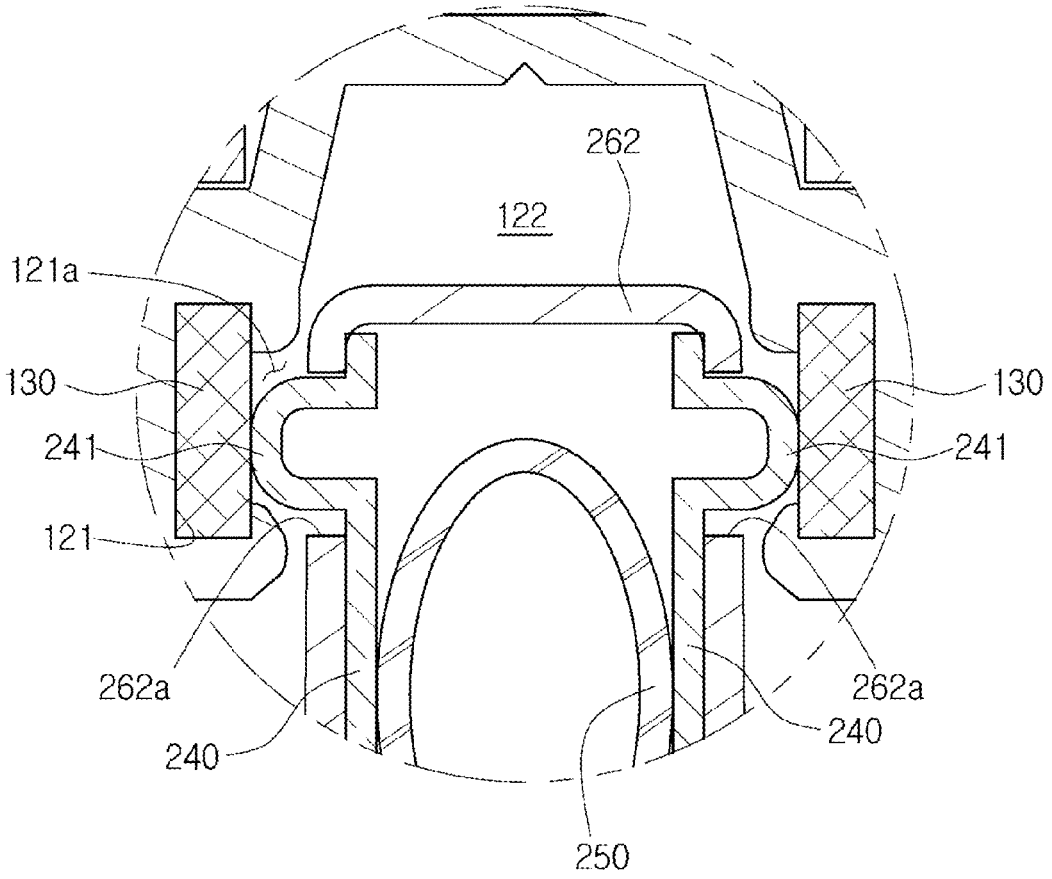
FIG. 6 is an enlarged view of portion "A" of FIG. 5.
Figure 7:
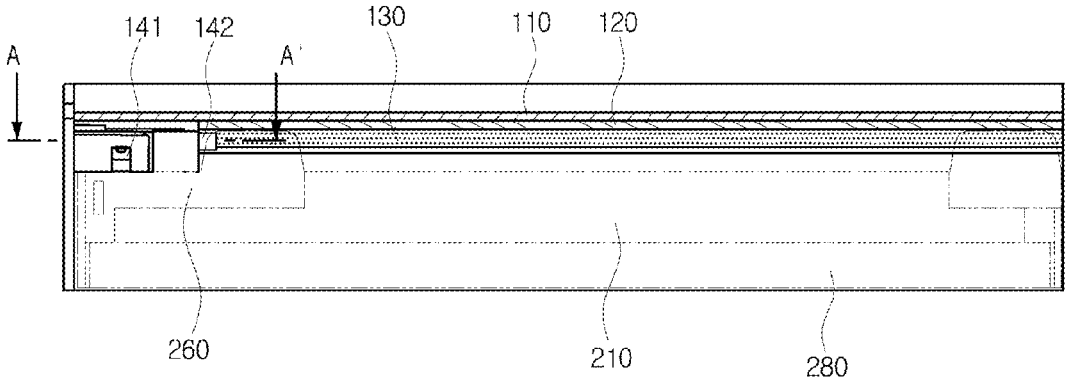
FIG. 7 is a front cross-sectional view of the linear lighting device according to the first exemplary embodiment of the present invention.
Figure 8:
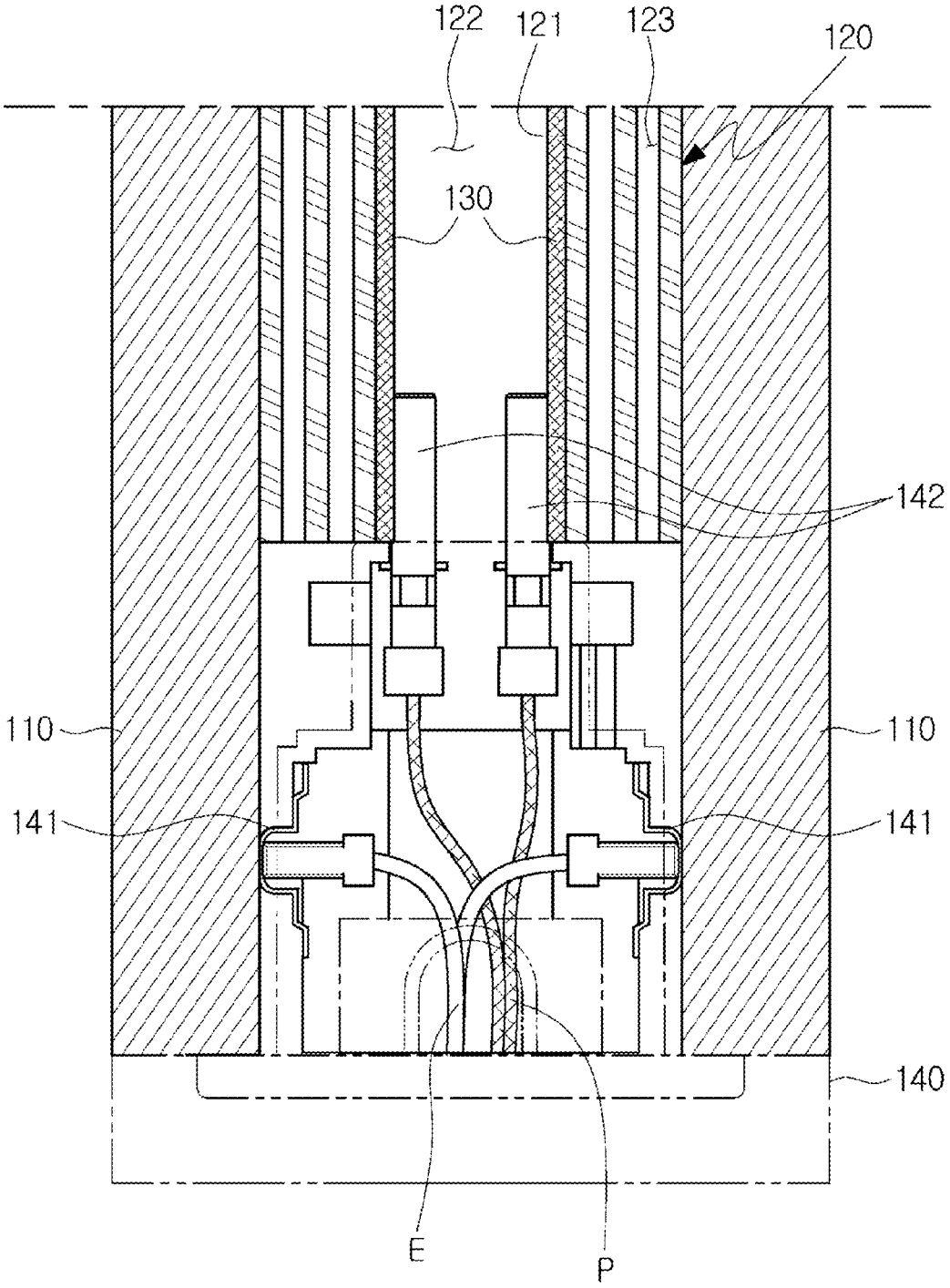
FIG. 8 is a cross-sectional view of FIG. 7, taken along line A-A'.

FIG. 5 is a side cross-sectional view of the linear lighting device according to the first exemplary embodiment of the present invention. FIG. 6 is an enlarged view of portion "A" of FIG. 5. FIG. 7 is a front cross-sectional view of the linear lighting device according to the first exemplary embodiment of the present invention. FIG. 8 is a cross-sectional view of FIG. 7, taken along line A-A'.

First, as illustrated in FIGS. 5 and 6, the housing 110 of the installation rail 100 may be directly fixed to an installation object surface C, and the insulating member 120 may be fixed to an inside surface of the housing 110 facing the open region, among inside surfaces of the housing 110. The power supply terminals 130 may be respectively inserted into the rail grooves 121 spaced apart from each other at both sides of a central portion of the bottom surface of the insulating member 120.

When the lighting module 200 is inserted into the accommodating space 111 through the opening of the housing 110, the second coupling portions 261 formed at both sides of an upper portion of the lighting body 210 of the lighting module 200 may be respectively inserted into the first coupling portions 123 of the insulating member 120 to thereby be engaged with each other, such that a state in which the lighting module 200 and the housing 110 are coupled to each other may be maintained.

In a state in which the lighting module 200 is inserted into the accommodating space 111 of the housing 110, the insertion projection 262 provided on the upper cover 260 of the lighting module 200 may be inserted into the accommodating groove 122 provided between the pair of power supply terminals 130 fixed to the insulating member 120.

In the lighting module 200, the circuit board 220 to which the SMPS 230 is fixed may be disposed in an upper internal space of the body 210 and the upper opening 211 may be closed by the upper cover 260, and the light emitting devices 270 may be disposed in a lower internal space of the body 210 in a length direction.

In a state in which the bottom portions of the power connection terminals 240 are fixed to the circuit board 220, the top portions of the power connection terminals 240 may be disposed in the form of free end portions within the insertion projection 262 of the upper cover 260. The contact protrusions 241 provided on the top portions of the power connection terminals 240 may be protruded outwardly from the insertion projection 262 through the open holes 262*a* formed in side surfaces of the insertion projection 262.

The power supply terminals 130 may be exposed through open grooves 121*a* formed in the surfaces of the insulating member facing the accommodation groove 122 while being accommodated in the rail grooves 121. Thus, the contact protrusions 241 of the power connection terminals 240 protruded outwardly from the insertion projection 262 may contact side surfaces of the power supply terminals 130 exposed through the open grooves 121*a*, such that the power connection terminals 240 and the power supply terminals 130 may be electrically connected to each other.

Since the pair of power connection terminals 240 may be elastically supported by the elastic member 250 elastically inserted in the space between the power connection terminals 240, toward the power supply terminals 130, a state in which they are closely adjacent to each other may be maintained. The pair of power connection terminals 240 may be electrically insulated from each other by the elastic member 250 formed of an insulating material, and the insulated state may be maintained.

In a state in which the lighting module 200 is inserted into the accommodating space 111 of the housing 110, a state in which the first coupling portions 123 and the second coupling portions 261 may be engaged with each other and coupled to each other may be maintained, and the power connection terminals 240 may come into contact with the power supply terminals 130 to thereby receive power. Power supplied to the lighting module 200 through the power connection terminals 240 may be transferred to the light emitting devices 270 through the SMPS 230.

According to the exemplary embodiment, the lighting module 200 may be assembled by simply pushing the lighting module 200 vertically in the accommodating space 111 of the housing 110 of the installation rail 100 and at the same time, the lighting module 200 may be configured to light up by receiving power, such that the installation and disassembling of the lighting module 200 may be facilitated. In particular, since the lighting module 200 may be freely movable in a length direction of the accommodating space 111 while being inserted into the accommodating space 111 of the housing 110, a position of the lighting module 200 may be simply moved even in the case of lighting up the lighting module 200.

In addition, since the second coupling portions 261 of the lighting module 200 may provide coupling force in a direction in which the lighting module is separated, that is, in a vertical direction, in a state in which the second coupling portions 261 of the lighting module 200 are engaged with the first coupling portions 123 of the housing 110, it may be possible to prevent the lighting module 200 from being arbitrarily separated from the housing 110 and from being dropped from the installation object surface.

In addition, since the power connection terminals 240 may be accommodated in the inside of the insertion projection 262, damage to the power connection terminals 240 due to external force during a process of installing the lighting module 200 on the housing 110 or separating the lighting module 200 from the housing 110 may be prevented.

Next, as illustrated in FIGS. 7 and 8, the end cap portions 140 may be coupled to the end portions of the housing 110 of the installation rail 100 and may close the end portions thereof. When end portions of the end cap portions 140 are inserted into the end portions of the housing 110 as described above, a pair of the power plugs 142 may be electrically connected to the pair of power supply terminals 130 previously installed in the housing 110 and at the same time, the ground plugs 141 may be electrically connected to inner wall surfaces of the housing 110.

Thus, power may be applied to the power supply terminals 130 through the power plugs 142 connected to the external power line, and the housing 110 formed of a conductive material may be connected to the external ground line through the ground plugs 141 to thereby be grounded.

Figure 9:
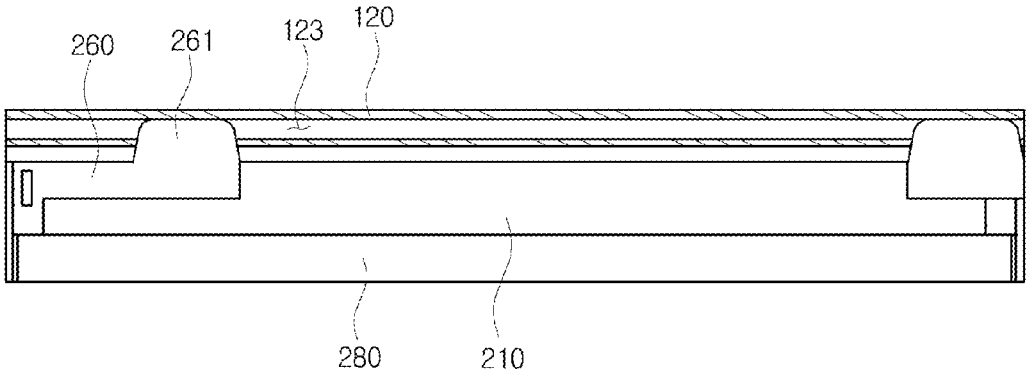
FIGS. 9 through 10 are operational views illustrating a process of separating the lighting module from the installation rail of the linear lighting device according to the first exemplary embodiment of the present invention.
Figure 10:
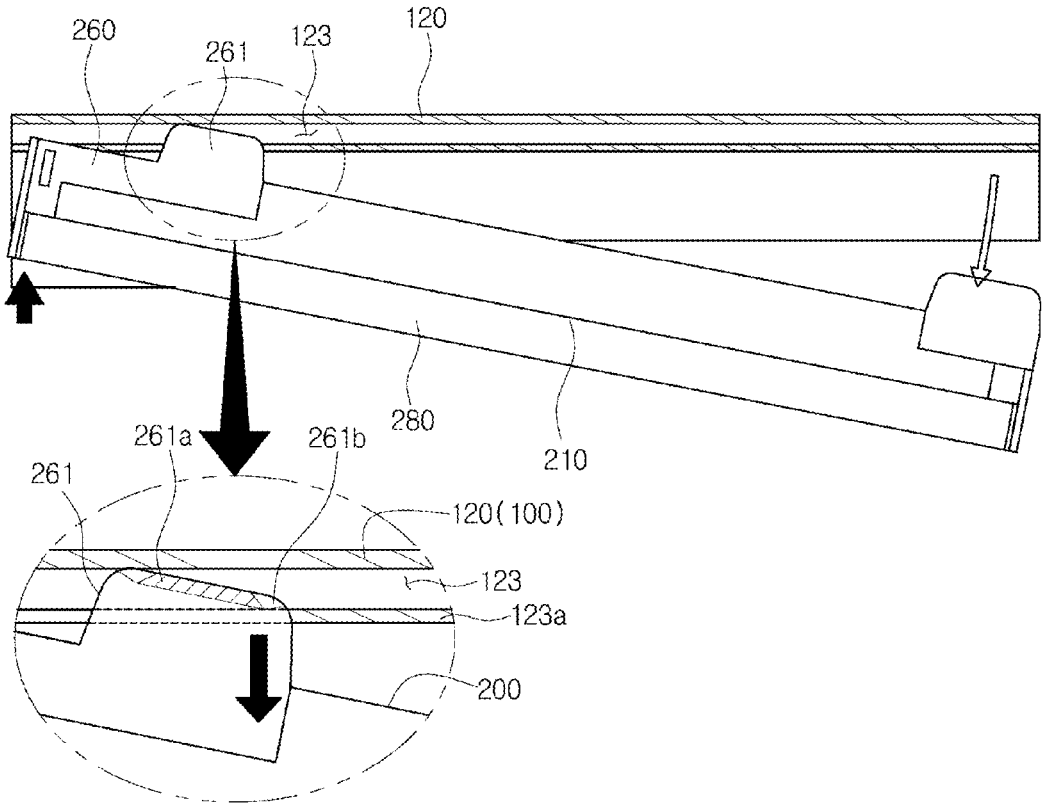

FIGS. 9 through 10 are operational views illustrating a process of separating the lighting module from the installation rail of the linear lighting device according to the first exemplary embodiment of the present invention.

First, as illustrated in FIG. 9, in a state in which the lighting module 200 is coupled to the installation module 100, the second coupling portions 261 of the lighting module 200 are engaged with the first coupling portions 123 of the installation rail 100, such that a coupling state of the lighting module 200 and the installation rail 100 may be maintained.

Since the protrusions 123*a* and 261*a* respectively formed on surfaces of the first coupling portions 123 and the second coupling portions 261 facing each other may be engaged with each other, it may be possible to prevent the lighting module 200 from being arbitrarily separated from the housing 110 (see FIG. 5).

Meanwhile, in the case that the length of the lighting module 200 is great, the second coupling portions 261 may be disposed on both end portions of the lighting module 200, such that a stable coupling state of the lighting module 200 may be maintained.

In this case, the second coupling portions 261 having protrusion shapes are coupled to the first coupling portions 123 having groove shapes, an upper surface of the upper cover 260 of the lighting module 200 is spaced apart from a lower surface of the insulating member 120, and the second coupling portions 261 of the lighting module 200 may be disposed in positions spaced apart from the end portions of the body 210 toward the central portion of the body 210 by a predetermined distance.

As illustrated in FIG. 10, in the case of separating the lighting module 200 from the installation module 100, one end portion of the lighting module 200 on which the second coupling portion 261 is spaced apart from one end of the lighting body 210 is pressed by an operator's one hand in an upward direction, while the other end portion of the lighting body 210 is taken down by the operator's the other hand, such that the second coupling portion 261 disposed on the other end portion of the lighting module 200 may be separated from the first coupling portion 123 while the lighting module 200 may pivot about the second coupling portion 261 disposed on one end portion of the lighting module 200, thereby allowing the other end portion of the lighting module 200 to be separated from the installation rail 100. In this case, since the second coupling portion 261 on one end portion of the lighting module 200 is engaged with the first coupling portion 123, the dropping of the lighting module 200 may be prevented.

Next, when the lighting module 200 is drawn in a direction in which the lighting module 200 is separated, while the other end portion of the lighting module 200 is grasped by the operator's hand, the second coupling portion 261 on one end portion of the lighting body 210 may be separated from the first coupling portion 123, such that the lighting module 200 may be easily separated from the installation rail 100.

In particular, in the case that one end portion of the lighting module 200 is drawn by the operator's hand in the separation direction, the protrusions 261*a* of the second coupling portion 261 may be detached from the protrusions 123*a* of the first coupling portion 123 due to the inclined surfaces 261*b* formed on ends of the protrusions 261*a* of the second coupling portion 261, such that the lighting module 200 may be easily separated from the housing 110.

That is, the insertion and separation of the lighting module 200 may be performed in a vertical direction. Thus, in a state in which a plurality of lighting modules 200 are closely adjacent to each other in a row to configure a linear lighting device providing continuity of illumination, the separation or the insertion of a single lighting module 200 may be facilitated to allow for simplification in maintenance thereof. In addition, in a process of separating the lighting module 200 from the installation rail 100 or coupling the lighting module 200 to the installation rail 100 by the operator, since a portion contacting the operator's body may be completely formed of an insulating material, the risk of the operator's electric shocks may be significantly reduced.

According to an exemplary embodiment of the present invention, only with an operation of pushing the lighting module 200 in the inside of the accommodating space 111 of the housing 110, since the lighting module 200 may be structurally connected to the installation rail 100 as well as being electrically connected thereto, the installation of the lighting module 200 may be significantly simplified. In addition, in a state in which the lighting module 200 is accommodated in the accommodating space 111 of the housing 110, since it may be movable in the length direction, a position of the lighting module 200 may be easily movable depending on a user's need. In addition, in the case of separating the lighting module 200 from the installation rail 100, the lighting module 200 may be separated with only an operation of sequentially drawing both end portions of the lighting module 200 in the separation direction.

Figure 11:
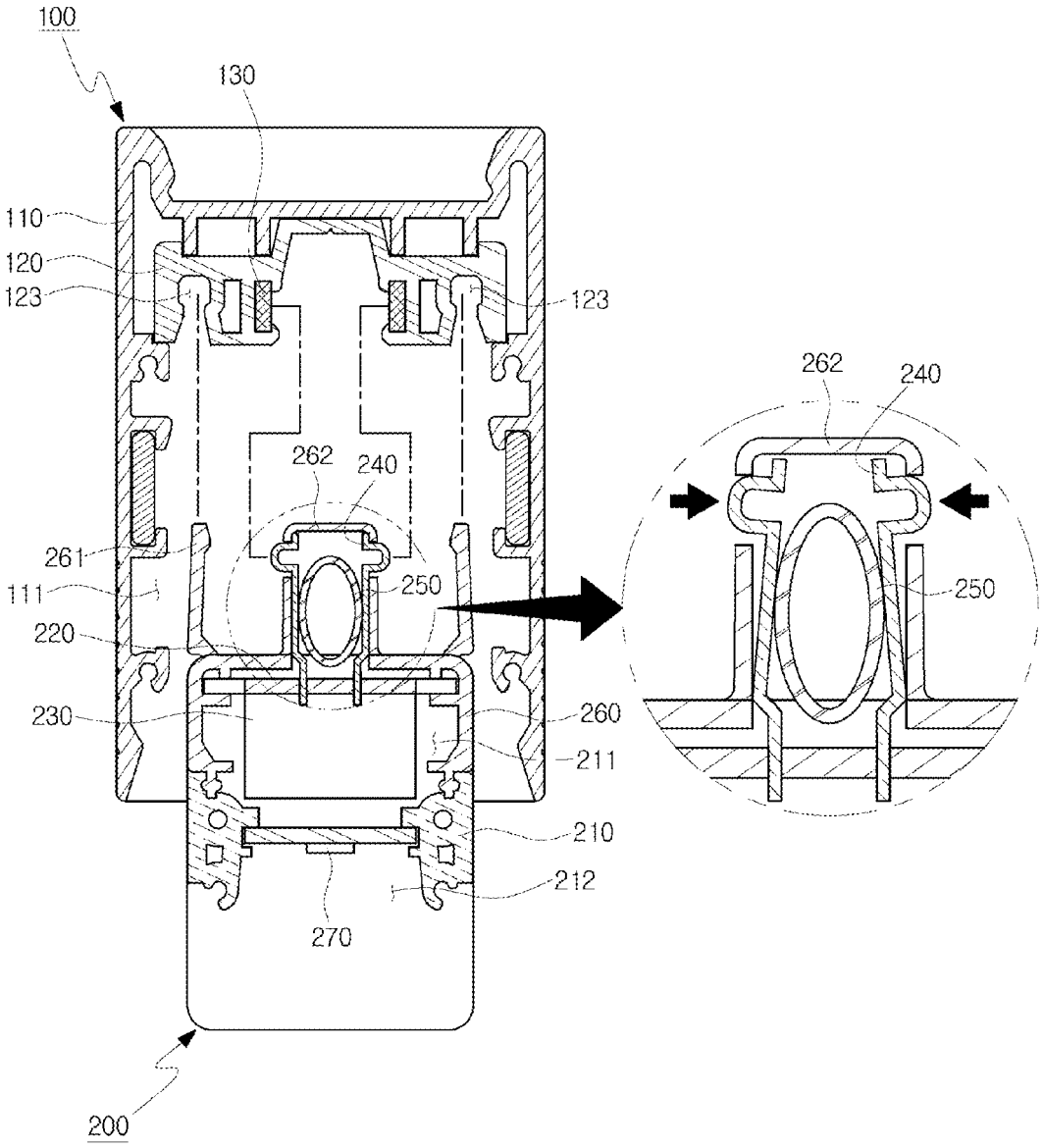
FIG. 11 is an operational view illustrating a process of separating a power connection terminal from a power supply terminal of the linear lighting device according to the first exemplary embodiment of the present invention.

FIG. 11 is an operational view illustrating a process of separating a power connection terminal from a power supply terminal of the linear lighting device according to the first exemplary embodiment of the present invention.

In a state of separating the lighting module 200 from the installation rail 100 by drawing the lighting module 200 in the separation direction, since the power supply terminals 130 respectively accommodated in the rail grooves 121 of the insulating member 120 may be exposed to only the accommodation groove 122 between the rail grooves 121 through the open grooves 121*a* provided in the rail grooves 121, the risk of operator electric shocks may be significantly reduced.

Meanwhile, the bottom portions of the power connection terminals 240 of the lighting module 200 may be fixed to the circuit board 220, while the top portions thereof may be accommodated in the inside of the insertion projection 262 without being fixed thereto. The top portions of the power connection terminals 240 may be elastically supported by the elastic body disposed between the pair of power connection terminals 240, toward the power supply terminals 130.

That is, in a process of inserting or detaching the insertion projection 262 into or from the accommodation groove 122 between the rail grooves 121, the contact protrusions 241 of the power connection terminals 240 may be movable in directions inwardly of the open holes 262*a* of the insertion projection 262. Thus, when pressure is applied to outside surfaces of the contact protrusions 241, the contact protrusions 241 may be recessed in the directions inwardly of the open holes 262*a* of the insertion projection 262. In such a process, the elastic member 250 supporting rear portions of the contact protrusions 241 may be elastically compressed. Meanwhile, when pressure applied to the outside surfaces of the contact protrusions 241 is released, the elastic member 250 may elastically restore and push the contact protrusions 241 in a protrusion direction thereof.

As described above, since the pair of power connection terminals 240 may be insulated from each other by the elastic member 250, while the contact protrusions 241 of the power connection terminals 240 may be elastically supported by elastic force of the elastic member 250 in the protrusion direction, a state in which the contact protrusions 241 may be in elastic contact with the power supply terminals 130 may be maintained while the lighting module 200 is inserted in the installation rail 100. Thus, even in the case that the lighting module 200 moves in the length direction thereof within the accommodating space 111 of the installation rail 100, a stable power supply to the lighting module 200 may be maintained.

Then, a linear lighting device according to a second exemplary embodiment of the present invention will be described.

Figure 12:
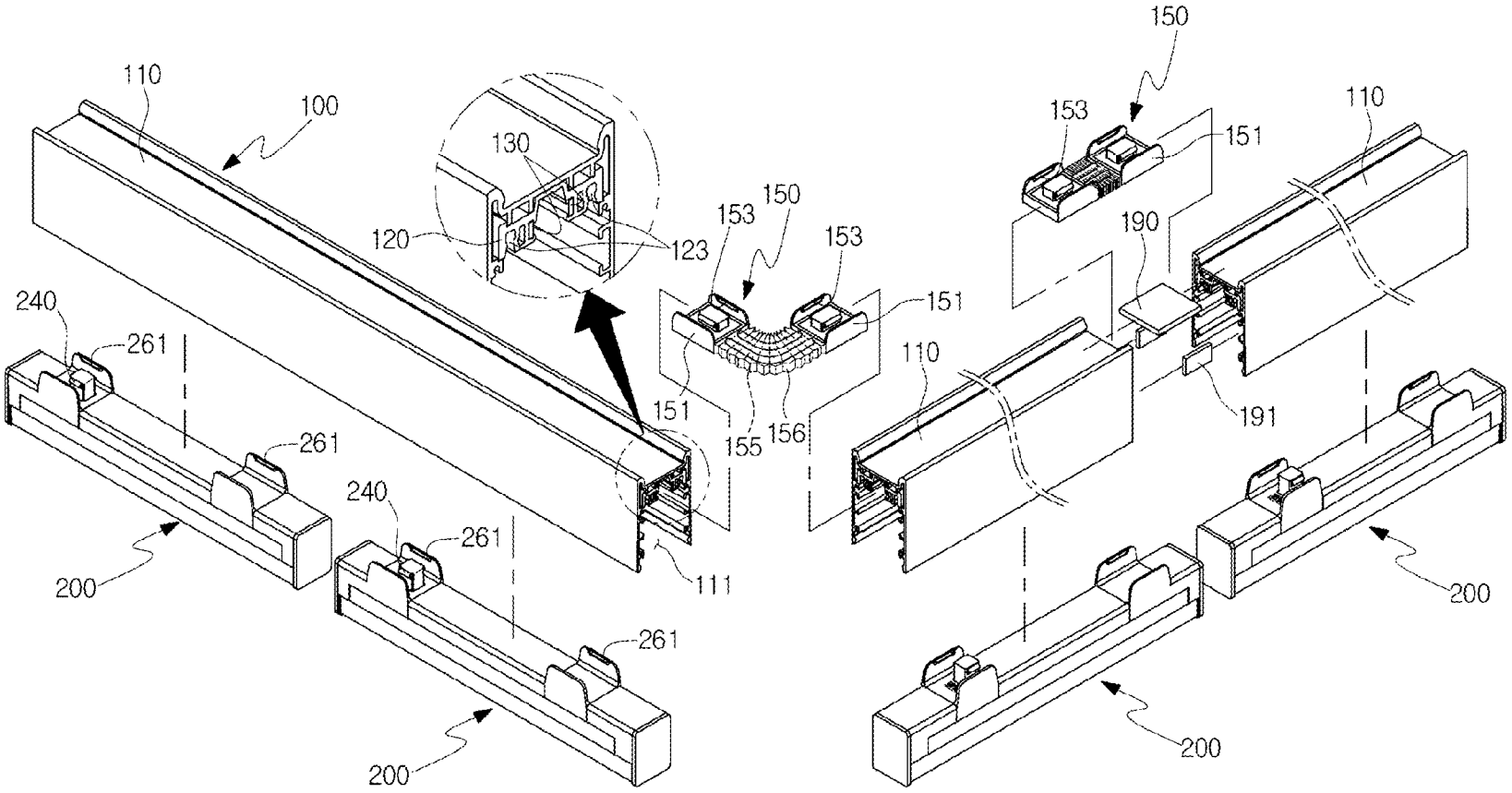
FIG. 12 is an exploded perspective view of a linear lighting device according to a second exemplary embodiment of the present invention.
Figure 13:
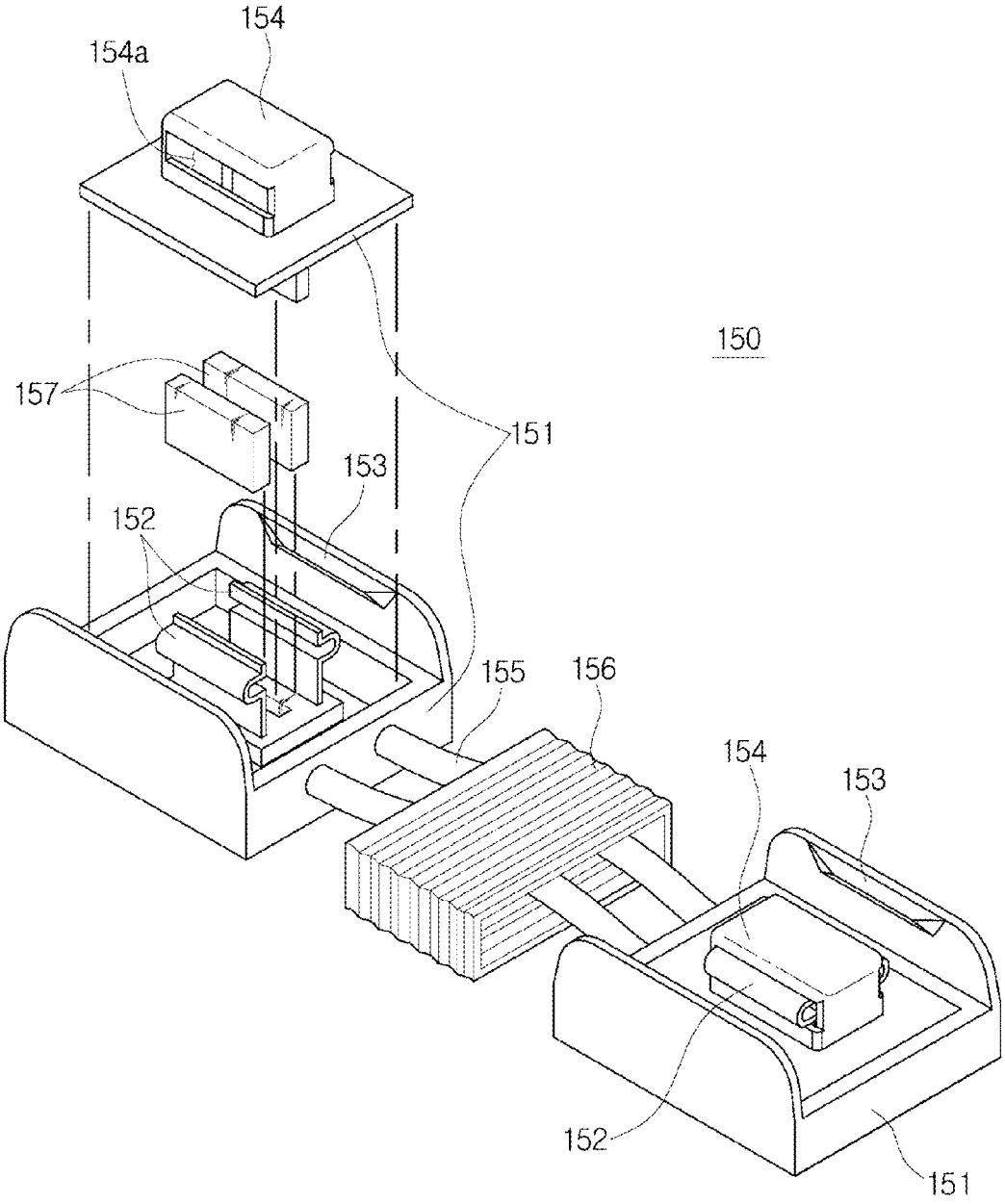
FIG. 13 is an exploded perspective view of a connection member according to the second exemplary embodiment of the present invention.
Figure 14:
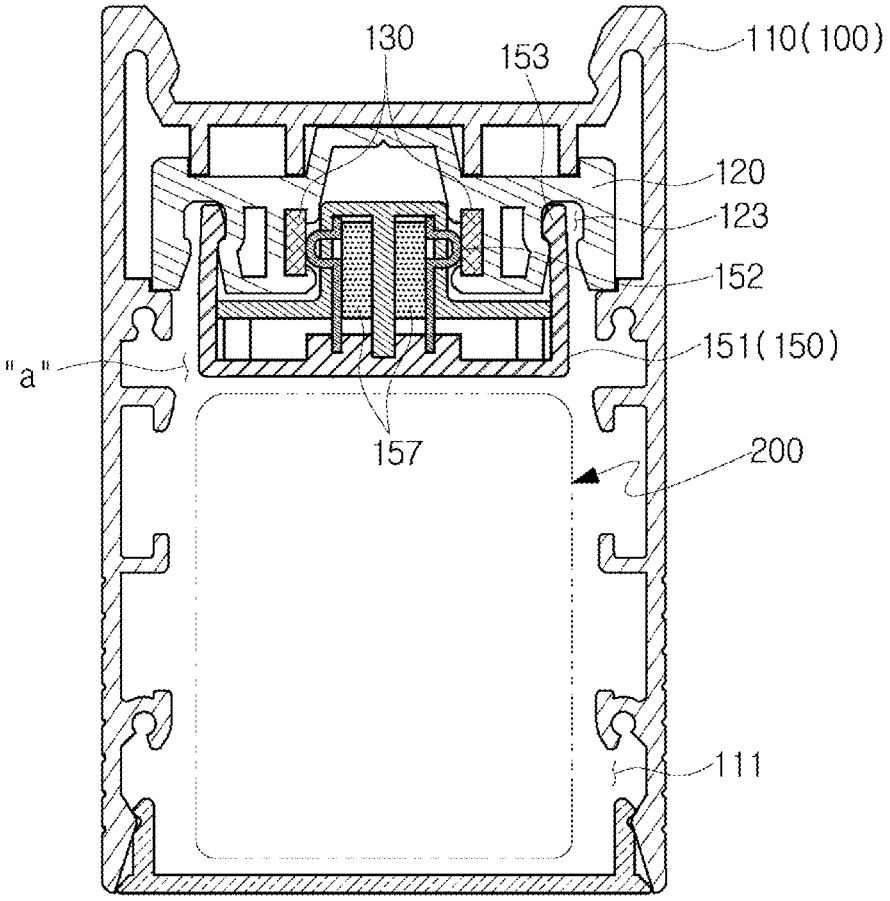
FIG. 14 is a side cross-sectional view of the linear lighting device according to the second exemplary embodiment of the present invention.
Figure 15:
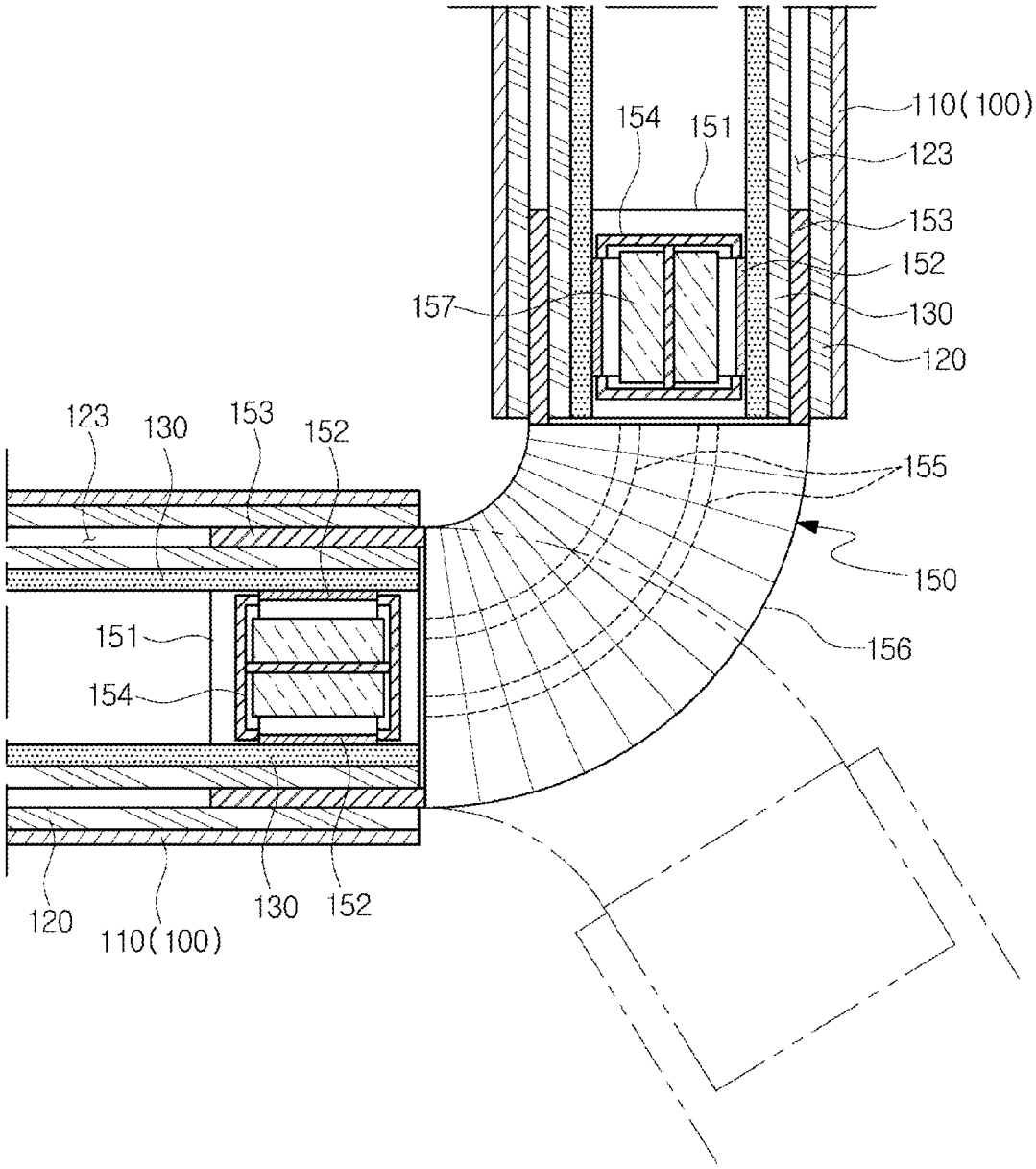
FIG. 15 is a planar cross-sectional view of the linear lighting device according to the second exemplary embodiment of the present invention.

FIG. 12 is an exploded perspective view of a linear lighting device according to a second exemplary embodiment of the present invention. FIG. 13 is an exploded perspective view of a connection member according to the second exemplary embodiment of the present invention. FIG. 14 is a side cross-sectional view of the linear lighting device according to the second exemplary embodiment of the present invention. FIG. 15 is a planar cross-sectional view of the linear lighting device according to the second exemplary embodiment of the present invention.

As illustrated in FIGS. 12 through 13, the linear lighting device according to the second exemplary embodiment of the present invention may be different from that of the foregoing first exemplary embodiment, in that the installation rail 100 may be configured of a plurality of housings 110 and a connection member 150 connecting the plurality of housings 110 may be provided to electrically connect the power supply terminals 130 installed in the housings 110 to each other.

The connection member 150 may be configured to include: insertion bodies 151 respectively, detachably inserted into the accommodating spaces 111 of a pair of the housings 110 adjacent to each other in a vertical direction; power connection terminals 152 which have lower ends fixed to an upper surface of each insertion body 151 and which are connected to the power supply terminals 130 of the housing 110; second coupling portions 153 protruded from both sides of the upper surface of the insertion body 151 in a direction perpendicular with respect thereto and coupled to the first coupling portions 123 of the insulating member 120; an insertion projection 154 having open holes 154*a* formed in side surfaces thereof facing the power supply terminals 130, the open holes 154*a* allowing the power connection terminals 152 to be exposed therethrough and covering upper ends of the power connection terminals 152; elastic members 157 disposed in the rear portions of the power connection terminals 152 and elastically supporting the power connection terminals 152, the elastic members 157 being formed of an insulating material; conductive cables 155 connecting the power connection terminals 152 respectively fixed to the plurality of insertion bodies 151; and a flexible tube 156 which is configured in the form of a tube having corrugations such as bellows and which has both ends thereof fixed to an edge of end portions of the insertion bodies 151.

Meanwhile, in the exemplary embodiment, since the power connection terminals 152, the second coupling portions 153, and the insertion projection 154 are formed in the same manner as those of the power connection terminals 240, the second coupling portions 261, and the insertion projection 264, a detailed description thereof may be omitted.

A coupling structure of the connection member 150 and a coupling structure of the connection member 150 and the housing 110 are described as below with reference to FIGS. 14 to 15.

The plurality of housings 110 disposed to have a predetermined angle therebetween as in the case of a corner portion of the installation object surface or disposed in a row may be electrically connected to each other by the connection member 150 disposed in a joint portion of the housings 110.

That is, when the plurality of insertion bodies 151 are inserted into the accommodating spaces 111 of the both housings 110 in the joint portion of the housings 110, the insertion bodies 151 may be coupled to the housings 110 and at the same time, the power connection terminals 152 may come into contact with the power supply terminals 130 to thereby be electrically connected thereto.

Referring to FIG. 14, in a state in which the bottom portions of the power connection terminals 152 are fixed to the insertion body 151, the top portions thereof may be elastically connected to the power supply terminals 130. In this case, since the power connection terminals 152 are elastically supported by the elastic members 157 toward the power supply terminals 130, a stable power connection thereof with the power supply terminals 130 may be performed. Moreover, the second coupling portions 153 formed to be protruded from the both sides of the upper surface of the insertion body 151 in the length direction thereof may be inserted into and coupled to the first coupling portions 123 of the housing 110, thereby preventing the second coupling portions 153 from being arbitrarily separated from the first coupling portions 123.

Then, as illustrated in FIG. 15, when the both insertion bodies 151 are inserted into the end portions of the pair of housings 110 adjacent to each other, since the power connection terminals 152 of the respective insertion bodies 151 may be connected to each other by the conductive cables 155, the power supply terminals 130 provided in the plurality of housings 110 may be electrically connected to each other by the connection member 150. In this case, an angle of the connection member 150 may be freely adjusted by the conductive cables 155 to thereby prevent a deterioration in construction quality due to construction error of the installation object surface C as in the related art.

Moreover, in the case of the conductive cables 155, since edges of both end portions thereof are accommodated in the inside of the flexible tube 156 fixed to the respective insertion bodies 151, it may be possible to prevent the conductive cables 155 from being unnecessarily, externally exposed in a state in which the installation rail 110 is installed to lead to a deterioration in product quality. In particular, since the connection member 150 does not limit an angle between the housings 110 to a predetermined angle unlike a "¬" shaped corner connection member according to the related art, various forms of lighting device may be displayed or disposed.

Moreover, the connection member 150 according to the exemplary embodiment may electrically connect the pair of housings 110 to each other by vertically inserting the connection member 150 in the joint portion of the housings 110 after installing the housings on the installation object surface C. Thus, the inconvenience of simultaneously installing the plurality of housings 110 on the installation object surface C in a state in which they are connected to each other may be improved.

Meanwhile, in the case of connecting the plurality of housings 110 to each other in a linear section, as illustrated in FIG. 12, both ends of a fixing bracket 190 and a connection bridge 191 slidably coupled to the housings 110 in a length direction thereof may be connected to end portions of the pair of housings 110 adjacent to each other, whereby the housings 110 present in the linear section may be connected to each other without the formation of a step portion, while maintaining structural rigidity thereof. In this case, since both insertion bodies 151 of the connection member 150 disposed between the pair of housings 110 may be connected to each other by the conductive cables 155 and the angle between the housings 110 may be freely adjusted, the connection member 150 may be disposed between the housings 110 in the linear section. In addition, at least one of the fixing bracket 190 and the connection bridge 191 may be formed of a conductive material and may be electrically connected to the plurality of housings 110 to be grounded.

Next, a linear lighting device according to a third exemplary embodiment of the present invention will be described.

Figure 16:
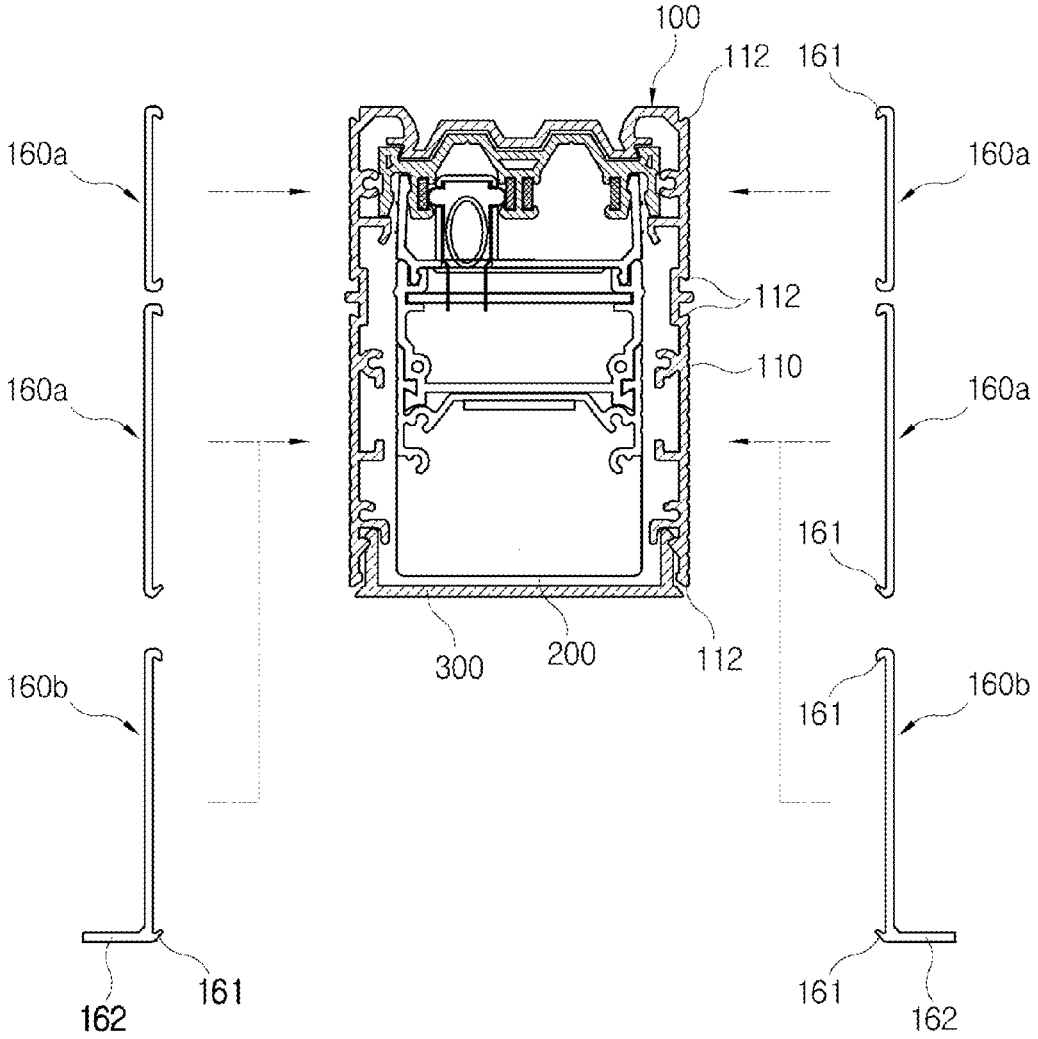
FIG. 16 is a cross-sectional view illustrating a state of applying a side member of a linear lighting device according to a third exemplary embodiment of the present invention.
Figure 17:
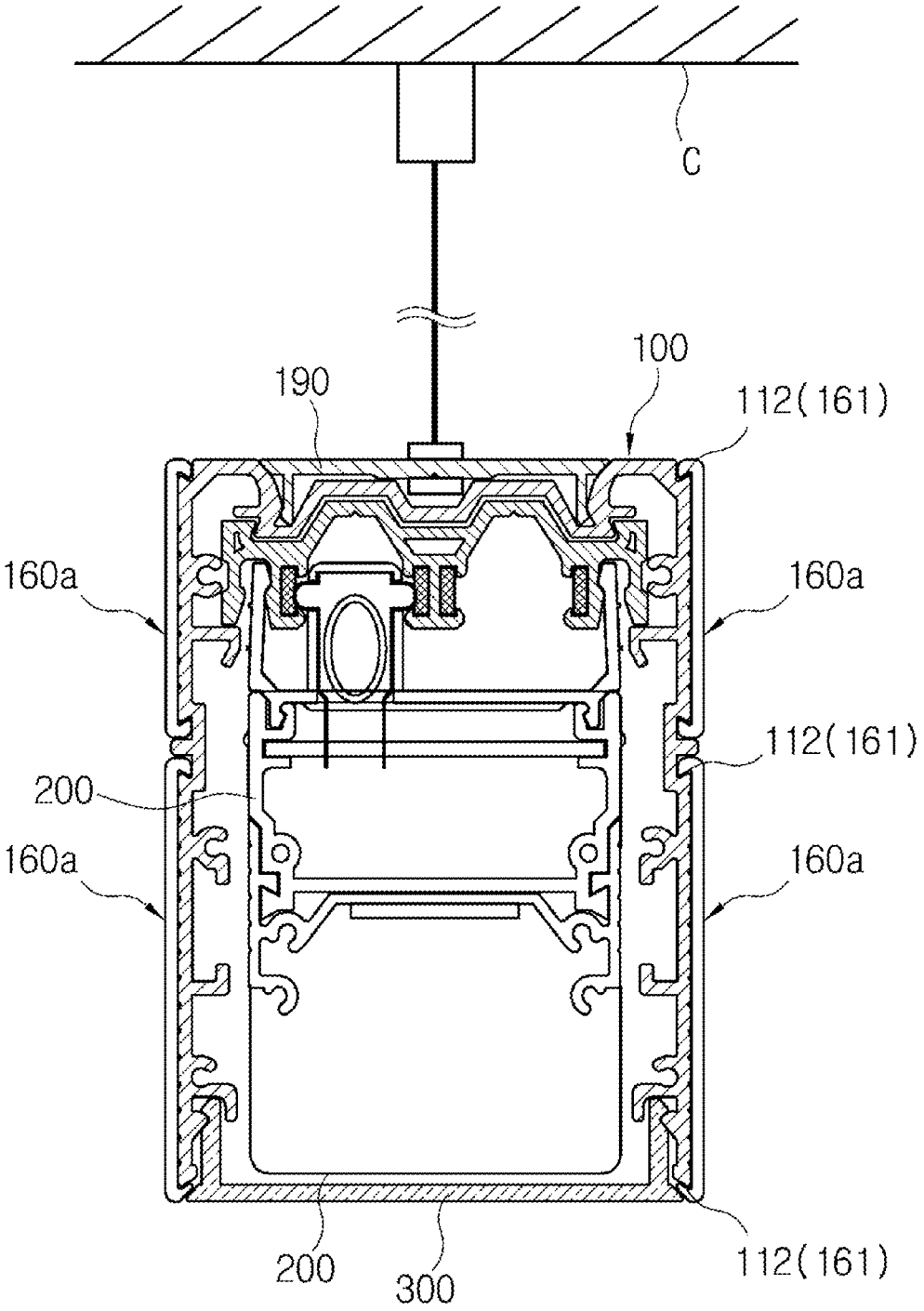
FIGS. 17 and 18 are cross-sectional views illustrating examples of applying the linear lighting device according to the third exemplary embodiment of the present invention.
Figure 18:
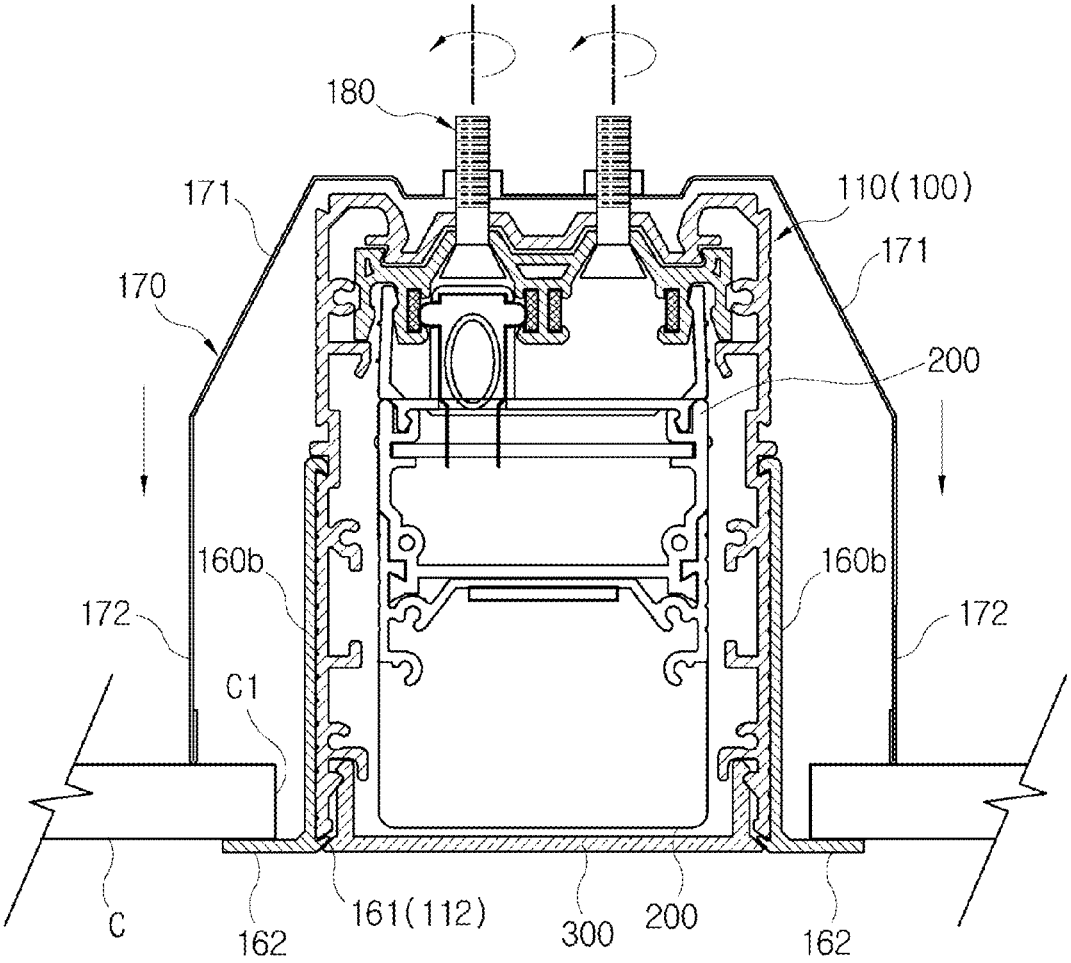

FIG. 16 is a cross-sectional view illustrating a state of applying a side member of the linear lighting device according to the third exemplary embodiment of the present invention. FIGS. 17 and 18 are cross-sectional views illustrating examples of applying the linear lighting device according to the third exemplary embodiment of the present invention.

First, as illustrated in FIG. 16, side members 160 variously formed depending on a form in which the housing 110 is installed may be detachably coupled to side surfaces of the housing 110 of the installation rail 100. That is, one of a first side member 160*a* having a simple plate shape and including a coating layer such as a high gloss layer formed on a surface thereof and a second side member 160*b* including a catching portion 162 formed to be bent from a bottom portion thereof and having an "L" shaped cross-section may be selectively coupled to the side surface of the housing 110 formed of a conductive metal material such as aluminum.

The first side member 160*a* is installed on the side surface of the housing 110 in the case that the housing 110 is installed to be exposed to the interior space. Thus, a color, a surface material or the like, of the first side member 160*a* may be selected to finish the exterior of the housing 110, such that the first side member 160*a* may be configured to finish the exterior of the installation rail 100 in various moods.

The second side member 160*b* is installed on the side surface of the housing 110 in the case that the housing 110 is embedded in the installation object surface. The catching portion 162 of the second side member 160*b* formed to be bent in a horizontal direction from a bottom portion of the second side member 160*b* may be supported by the outer circumferential portion of the installation object surface C around the installation groove C1 to guide an insertion position of the housing 110, as well as to close a gap between the housing 110 and the installation groove C1.

A pair of second fastening portions 161 may be disposed in parallel to be spaced apart from each other on surfaces of the first side member 160*a* and the second side member 160*b* facing the housing 110, and first fastening portions 112 may be formed on an outer side surface of the housing 110, the first fastening portions 112 being engaged with the second fastening portions 161.

FIG. 17 illustrates a state in which the linear lighting device according to the present invention is installed to be exposed outwardly, and the first side member 160*a* having a simple plate shape may be fixed to the side surface of the housing 110. That is, the second fastening portions 161 formed on an inner side surface of the first side member 160*a* may be engaged with the first fastening portions 112 formed on the side surface of the housing 110, such that the first side member 160*a* may be coupled to the side surface of the housing 110.

Meanwhile, as in the drawings, the side members 160*a* may be arranged in a vertical direction on the side surface of the housing 110 and may be configured to have various colors. In addition, the upper surface of the housing 110 may be directly fastened and fixed to the installation object surface C or the fixing bracket 190 previously installed on the installation object surface C using binding mechanism such as a wire or the like may be detachably fixed to the upper surface of the housing 110, such that the installation rail 100 may be installed on the installation object surface C while being present in a suspended state thereof.

In particular, in a state in which the housing 110 is formed of a conductive metal material to allow for a ground line connected to the housing 110, since the outer side surface of the housing is decorated with the first side member 160*a*, a cumbersome coating process of performing a thermal treatment after conducting powder coating on the entirety of an external surface of the housing 110 as in the related art may be omitted.

FIG. 18 illustrates a state in which the linear lighting device according to the present invention is installed in an embedded scheme. In FIG. 18, the catching portion 162 may be formed to be bent from the bottom portion of the side surface of the housing 110, and the second side member 160*b* having an "L" shaped cross-section may be fixed to the side surface of the housing 110. In a similar manner to the first side member 160*a*, the second fastening portions 161 may be coupled to the first fastening portions 112 provided on the housing 110 to be fixed to the housing 110.

On the upper surface of the housing 110, a fixing member 170 having elastic portions 171 inclinedly disposed from both sides thereof may be movably disposed by adjusting members 180 in a vertical direction from the upper surface of the housing 110, that is, in a thickness direction of the installation object surface C. End portions of the elastic portions 171 may be provided with support portions 172 respectively forming a substantially right angle with respect to the inside surface of the installation object surface C in a state in which the elastic portions 171 are elastically restored.

In a state in which the fixing member 170 is coupled to the upper surface of the housing 110 as described above, when the housing 110 is pushed in the installation groove C1 of the installation object surface C, the inclined elastic portions 171 of the fixing member 170 may be elastically compressed toward the side surfaces of the housing 110 and then, may be widened to be away from the side surfaces of the housing 110 while being elastically restored, at the moment in which edges of the elastic portions 171 pass through the installation groove C1.

In this state, in the case of rotating the adjusting members 180 which penetrate through the upper surface of the housing 110 in a vertical direction and which are screw-coupled with the fixing member 170, the fixing member 170 may descend due to the rotation of the adjusting members 180 and may be adhered closely to the inside surface of the installation object surface C. Owing to such an operation, since the catching portion 162 of the second side member 160*b* may be adhered closely to an outside surface of the installation object surface C, the housing 110 may be stably fixed to the installation object surface C.

In addition, since the support portions 172 formed at the edges of the elastic portions 171 and supported by the inside surface of the installation object surface C may be respectively disposed to form a substantially right angle with respect to the inside surface of the installation object surface C, it may be possible to prevent a distance between the fixing member 170 and the catching portion 162 from being changed while positions of the elastic portions 171 are arbitrarily moved.

In particular, a gap formed between the installation groove C1 and the housing 110 may be necessarily required to allow the elastic portions 171 to pass therethrough, and a size of the installation groove C1 determining the gap may be differently set depending on a construction shape or method, or the like. Thus, a plurality of second side members 160*b*, the catching portions 162 of which have different lengths, may be prepared and among the plurality of second side members 160*b*, a second side member 160*b* having the catching portion 162 corresponding to the gap formed between the installation groove C1 and the housing 110 may be selected to be coupled to the side surface of the housing 110. Thus, it may be unnecessary to separately manufacture various types of housings 110 depending on a size of the gap.

Meanwhile, in the case of separating the housing 110 from the installation groove C1 of the installation object surface C, when the adjusting members 180 rotate in a reverse direction, since the fixing member 170 screw-coupled with the adjusting members 180 may be separated from the upper surface of the housing 110 while moving in an upward direction, the housing 110 may be simply separated from the installation object surface C.

It is to be understood that the invention is not limited to the disclosed embodiments, but, on the contrary, may be embodied in various embodiments and that various modifications may be made to the invention by one skilled in the art without departing from the spirit and scope of the invention as defiled in the appended claims.

INDUSTRIAL APPLICABILITY

The present invention relates to a linear lighting device and more particularly, to a linear lighting device capable of being simply constructed by simply connecting a plurality of housings to each other in configuring an installation rail for installing a lighting module, as well as by simultaneously, electrically connecting the housings to each other in a structural connection operation.

What is claimed is:

1. A linear lighting device comprising:

an installation rail including a housing and a power supply terminal, the housing being fixed to an installation object surface and having an accommodating space formed therein, the accommodating space having an open side in one surface thereof, the power supply terminal being disposed in the accommodating space of the housing in a length direction thereof;

at least one linear lighting module including a power connection terminal and a light emitting device, the power connection terminal being electrically connected to the power supply terminal, the light emitting device being electrically connected to the power connection terminal, the linear lighting module being detachably coupled to the accommodating space of the housing; and a light transmissive cover detachably coupled to the housing so as to close the open side of the accommodating space of the housing;

wherein the installation rail has a first coupling portion formed thereon and the lighting module has a second coupling portion formed in a position corresponding to the first coupling portion, the first coupling portion and the second coupling portion being engaged with each other in a state in which the lighting module is accommodated in the accommodating space of the housing, wherein the first coupling portion and the second coupling portion have protrusions formed on surfaces thereof facing each other, the protrusions being engaged with each other, and wherein both ends of the protrusion of the second coupling portion is provided with inclined surfaces to guide separation of the second coupling portion, accommodating space of the housing in a length direction thereof, and wherein the power connection terminal is disposed on an upper surface of the lighting module such that a side portion of the power connection terminal contacts a side portion of the power supply terminal in a state in which the lighting module is coupled to the housing, wherein the power supply terminal is formed of a pair of power supply terminals which are disposed in parallel and which are spaced apart from each other, while the power connection terminal is formed of a pair of power connection terminals which are disposed in parallel and which are spaced apart from each other, and one pair of the pair of power supply terminals and the pair of power connection terminals are inserted into a space between the other pair of the pair of power supply terminals and the pair of power connection terminals, wherein the power connection terminals are inserted into the space between the power supply terminals, and wherein an elastic member formed of an elastic material is inserted into a space between the pair of power connection terminals and elastically supports the power connection terminals toward the power supply terminals.

2. The linear lighting device of claim 1, wherein the installation rail further includes an end cap portion coupled to an end portion of the housing, and wherein the end cap portion includes a ground plug connecting the housing formed of a conductive material and an external ground line to each other.

3. The linear lighting device of claim 1, wherein the power supply terminal is electrically insulated from the housing by an insulating member accommodated in the accommodating space of the housing.

4. The linear lighting device of claim 1, wherein the power supply terminal is accommodated in a rail groove of an insulating member accommodated in the accommodating space of the housing and is electrically insulated from the housing, and wherein the rail groove is provided with an open groove allowing the power supply terminal to be exposed and the open groove is provided on a side portion of the rail groove facing the power connection terminal.

5. The linear lighting device of claim 1, wherein the lighting module is provided with an insertion projection which covers the pair of power connection terminals and which is accommodated in the space between the power supply terminals, wherein open holes are formed in surfaces of the insertion projection facing the power supply terminals, and the power connection terminals are provided with contact protrusions which are protruded outwardly from the insertion projection through the open holes to come into contact with the power supply terminals.

6. The linear lighting device of claim 2, wherein the end cap portion further includes a power plug connecting the power connection terminal of the housing and an external power line to each other.

7. A linear lighting device comprising:

an installation rail including a housing and a power supply terminal, the housing being fixed to an installation object surface and having an accommodating space formed therein, the accommodating space having an open side in one surface thereof, the power supply terminal being disposed in the accommodating space of the housing in a length direction thereof;

at least one linear lighting module including a power connection terminal and a light emitting device, the power connection terminal being electrically connected to the power supply terminal, the light emitting device being electrically connected to the power connection terminal, the linear lighting module being detachably coupled to the accommodating space of the housing; and a light transmissive cover detachably coupled to the housing so as to close the open side of the accommodating space of the housing;

wherein the installation rail has a first coupling portion formed thereon and the lighting module has a second coupling portion formed in a position corresponding to the first coupling portion, the first coupling portion and the second coupling portion being engaged with each other in a state in which the lighting module is accommodated in the accommodating space of the housing, wherein the first coupling portion and the second coupling portion have protrusions formed on surfaces thereof facing each other, the protrusions being engaged with each other, and wherein both ends of the protrusion of the second coupling portion is provided with inclined surfaces to guide separation of the second coupling portion, wherein the installation rail further includes a side member detachably coupled to a side portion of the housing;

wherein the side member has a catching portion which is bent from a bottom portion thereof and which is adhered to an outer circumferential portion of the installation object surface around an installation groove.

8. The linear lighting device of claim 7, wherein the installation rail further includes a fixing member which is fixed to an upper surface of the housing and which has elastic portions inclinedly disposed at both sides thereof, the fixing member being adhered to an inner circumferential portion of the installation object surface around the installation groove.

9. The linear lighting device of claim 8, wherein a position of the fixing member is adjusted by an adjusting member in a thickness direction of the installation object surface.

10. The linear lighting device of claim 9, wherein first coupling portions and second coupling portions detachably engaged with each other are disposed on surfaces where the side member and the housing are coupled, the first coupling portions and the second coupling portions being disposed in parallel in a length direction of the housing.

11. A linear lighting device comprising:

an installation rail including a housing and a power supply terminal, the housing being fixed to an installation object surface and having an accommodating space formed therein, the accommodating space having an open side in one surface thereof, the power supply terminal being disposed in the accommodating space of the housing in a length direction thereof;

at least one linear lighting module including a power connection terminal and a light emitting device, the power connection terminal being electrically connected to the power supply terminal, the light emitting device being electrically connected to the power connection terminal, the linear lighting module being detachably coupled to the accommodating space of the housing; and a light transmissive cover detachably coupled to the housing so as to close the open side of the accommodating space of the housing;

wherein the installation rail has a first coupling portion formed thereon and the lighting module has a second coupling portion formed in a position corresponding to the first coupling portion, the first coupling portion and the second coupling portion being engaged with each other in a state in which the lighting module is accommodated in the accommodating space of the housing, wherein the first coupling portion and the second coupling portion have protrusions formed on surfaces thereof facing each other, the protrusions being engaged with each other, and wherein both ends of the protrusion of the second coupling portion is provided with inclined surfaces to guide separation of the second coupling portion, wherein the installation rail further includes a connection member including an insertion body and a power connection terminal, the insertion body being vertically and detachably inserted into each of accommodating spaces of a pair of housings adjacent to each other, the power connection terminal being fixed to the insertion body and being connected to each of power supply terminals of the both housings.

12. The linear lighting device of claim 11, wherein the connection member includes a plurality of insertion bodies and a plurality of power connection terminals, the plurality of insertion bodies and the plurality of power connection terminals being respectively inserted into the accommodating spaces of the pair of housings adjacent to each other, the plurality of power connection terminals being connected to each other by a conductive cable.

13. The linear lighting device of claim 11, wherein a first coupling portion and a second coupling portion are formed on surfaces where the insertion body and the housing face each other, the first coupling portion and the second coupling portion being engaged with each other in a state in which the insertion body is inserted into the accommodating space of the housing.

14. The linear lighting device of claim 11, wherein in a state in which the lighting module is inserted in the accommodating space of the housing, a space is formed between the lighting module and the housing, the insertion body being accommodated in the space.

15. The linear lighting device of claim 12, wherein the connection member further includes a flexible tube, both an edge of end portions of the flexible tube being respectively fixed to an edge of end portions of the insertion bodies.

* * * * *